US011024946B2

(12) United States Patent
Koga et al.

(10) Patent No.: US 11,024,946 B2
(45) Date of Patent: Jun. 1, 2021

(54) ANTENNA DEVICE AND WIRELESS COMMUNICATION DEVICE

(71) Applicant: FUJITSU LIMITED, Kawasaki (JP)

(72) Inventors: Yohei Koga, Kawasaki (JP); Takashi Yamagajo, Yokosuka (JP); Manabu Kai, Yokohama (JP); Tabito Tonooka, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 16/286,419

(22) Filed: Feb. 26, 2019

(65) Prior Publication Data

US 2019/0190124 A1 Jun. 20, 2019

Related U.S. Application Data

(63) Continuation of application No. PCT/JP2018/012696, filed on Mar. 28, 2018.

(30) Foreign Application Priority Data

Jun. 15, 2017 (JP) ..... JP2017-118088

(51) Int. Cl.
*H01Q 1/24* (2006.01)
*H01Q 5/10* (2015.01)
(Continued)

(52) U.S. Cl.
CPC ..... *H01Q 1/243* (2013.01); *H01Q 1/48* (2013.01); *H01Q 5/10* (2015.01); *H01Q 5/371* (2015.01);
(Continued)

(58) Field of Classification Search
CPC ..... H01Q 1/243; H01Q 1/48; H01Q 9/42; H01Q 5/371; H01Q 5/378; H01Q 7/00; H01Q 9/04; H01Q 5/10
See application file for complete search history.

(56) References Cited

U.S. PATENT DOCUMENTS 7,439,917 B2 * 10/2008 Harano ..... H01Q 1/243 343/702
2004/0008146 A1 1/2004 Ikegaya et al.
(Continued)

FOREIGN PATENT DOCUMENTS

CN 102983405 A 3/2013
EP 2 784 873 A1 10/2014
(Continued)

OTHER PUBLICATIONS

International Search Report issued in corresponding PCT Application No. PCT/JP2018/012696, dated Jun. 5, 2018.
(Continued)

*Primary Examiner* — Dieu Hien T Duong
(74) *Attorney, Agent, or Firm* — Arent Fox LLP

(57) ABSTRACT

An antenna device includes: a ground plane which has an edge side; a metal member arranged along the edge side of the ground plane; a first connection line which couples the metal member and the ground plane; a second connection line which couples the metal member and the ground plane; and a power feeding element which has a power feeding point, extends along the metal member from the power feeding point between the first connection line and the second connection line, and is electromagnetic-field-coupled to the metal member.

14 Claims, 24 Drawing Sheets

(51) Int. Cl.

| | |
|---|---|
| ***H01Q 9/04*** | (2006.01) |
| ***H01Q 7/00*** | (2006.01) |
| ***H01Q 5/378*** | (2015.01) |
| ***H01Q 5/371*** | (2015.01) |
| ***H01Q 9/42*** | (2006.01) |
| ***H01Q 1/48*** | (2006.01) |

(52) U.S. Cl.
CPC ..... *H01Q 5/378* (2015.01); *H01Q 7/00* (2013.01); *H01Q 9/04* (2013.01); *H01Q 9/42* (2013.01)

(56) References Cited

U.S. PATENT DOCUMENTS

| | | | | |
|---|---|---|---|---|
| 2004/0196189 | A1* | 10/2004 | Yeh | H01Q 9/30 343/700 MS |
| 2013/0057437 | A1 | 3/2013 | Chiu et al. | |
| 2014/0132457 | A1* | 5/2014 | Galeev | H01Q 1/243 343/702 |
| 2014/0292590 | A1 | 10/2014 | Yoo et al. | |
| 2014/0347229 | A1 | 11/2014 | Chen et al. | |
| 2015/0048979 | A1* | 2/2015 | Asrani | H01Q 1/521 343/702 |
| 2015/0084817 | A1* | 3/2015 | Yong | H01Q 5/335 343/702 |
| 2015/0207211 | A1 | 7/2015 | Martiskainen et al. | |
| 2015/0270610 | A1 | 9/2015 | Kodama | |

FOREIGN PATENT DOCUMENTS

| | | | |
|---|---|---|---|
| EP | 3 043 419 | A1 | 7/2016 |
| JP | 2004-048119 | A | 2/2004 |
| JP | 2007-180656 | A | 7/2007 |
| JP | 2009-165003 | A | 7/2009 |
| JP | 2010-028521 | A | 2/2010 |
| JP | 2014-200088 | A | 10/2014 |
| WO | WO 2012/144197 | A1 | 10/2012 |
| WO | WO 2014/064786 | A1 | 5/2014 |
| WO | WO 2014/068192 | A1 | 5/2014 |

OTHER PUBLICATIONS

Written Opinion of the International Searching Authority issued in corresponding PCT Application No. PCT/JP2018/012696, dated Jun. 5, 2018. (with Partial Translation).

Chinese Office Action issued by the Chinese Patent Office in corresponding Chinese Application No. 201880003596.7, dated Jul. 20, 2020.

The Second Office Action issued from the State Intellectual Property Office of People's Republic of China in counterpart Application No. 201880003596.7, dated Feb. 20, 2021.

* cited by examiner

CURRENT DISTRIBUTION AT f1 (0.85 GHz)

CURRENT DISTRIBUTION AT f2 (1.65 GHz)

CURRENT DISTRIBUTION AT f3 (2.0 GHz)

CURRENT DISTRIBUTION AT f4 (2.4 GHz)

ANTENNA DEVICE AND WIRELESS COMMUNICATION DEVICE

CROSS-REFERENCE TO RELATED APPLICATION

This application is a continuation application of International Application PCT/JP2018/012696 filed on Mar. 28, 2018 and designated the U.S., the entire contents of which are incorporated herein by reference. The International Application PCT/JP2018/012696 is based upon and claims the benefit of priority of the prior Japanese Patent Application No. 2017-118088, filed on Jun. 15, 2017, the entire contents of which are incorporated herein by reference.

FIELD

The embodiments discussed herein are related to antenna devices and wireless communication devices.

BACKGROUND

Conventionally, an antenna device is provided.

Related art is disclosed in Japanese Laid-open Patent Publication No. 2010-028521.

SUMMARY

According to one aspect of the embodiments, an antenna device includes: a ground plane which has an edge side; a metal member arranged along the edge side of the ground plane; a first connection line which couples the metal member and the ground plane; a second connection line which couples the metal member and the ground plane; and a power feeding element which has a power feeding point, extends along the metal member from the power feeding point between the first connection line and the second connection line, and is electromagnetic-field-coupled to the metal member.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

For example, an antenna device includes a power feeding element, a parasitic element capable of being coupled to the power feeding element in a high frequency manner, a substrate for generating electric images of the power feeding element and the parasitic element, and switching means which switches, for each of a plurality of switching locations defined in advance of the parasitic element, between a short-circuited state in which the switching location and the substrate are short-circuited and an open state in which the switching location is opened.

Meanwhile, the antenna device achieves a plurality of resonance frequencies by switching the switching means (switch), and the structure may not be simple.

An antenna device with a simple structure and a wireless communication device may be provided.

In the following, an embodiment to which the antenna device and the wireless communication device of the present invention are applied is described.

Embodiment

Figure 1:
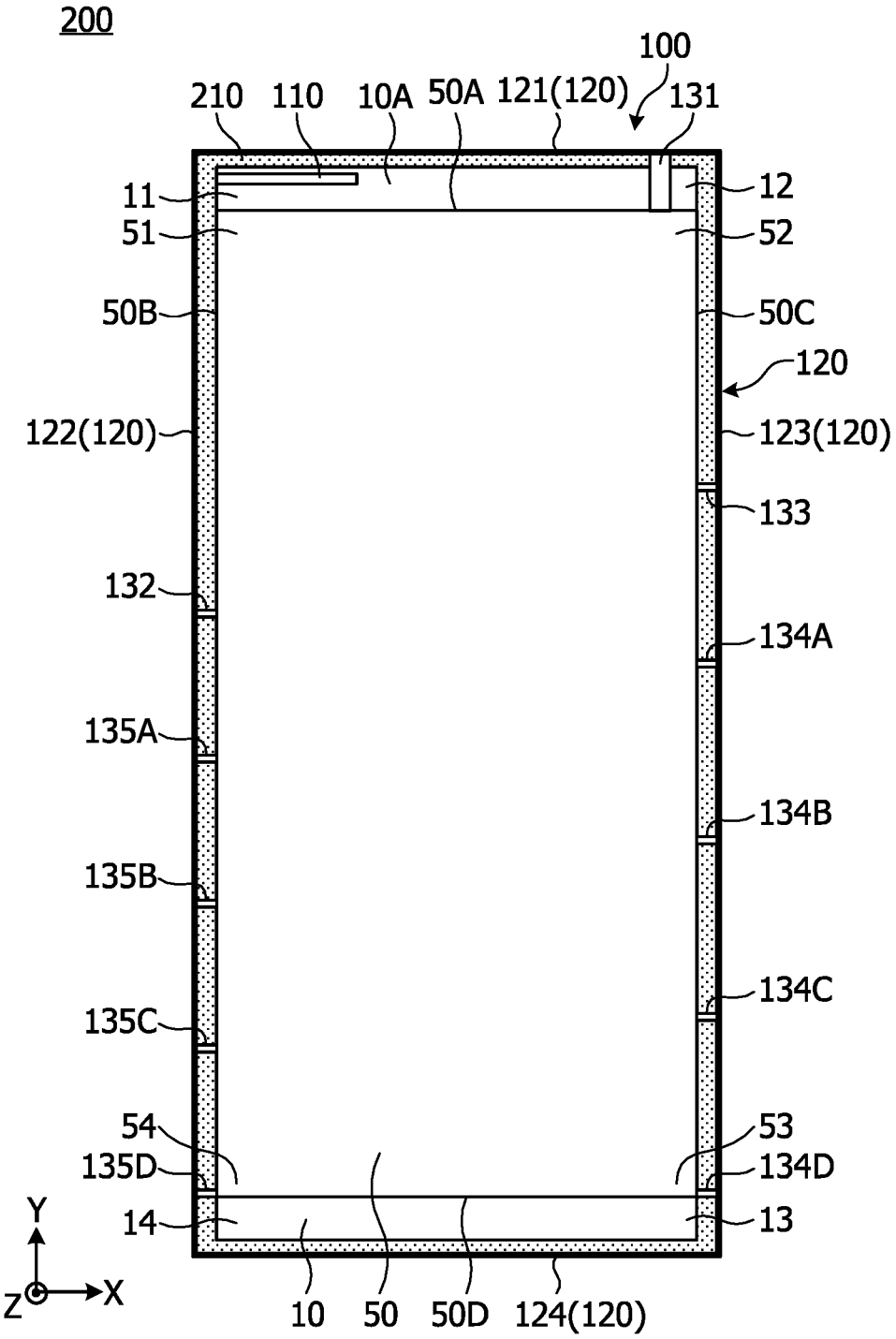
FIG. 1 is a diagram depicting a wireless communication device 200 including an antenna device 100 of an embodiment.
Figure 2:
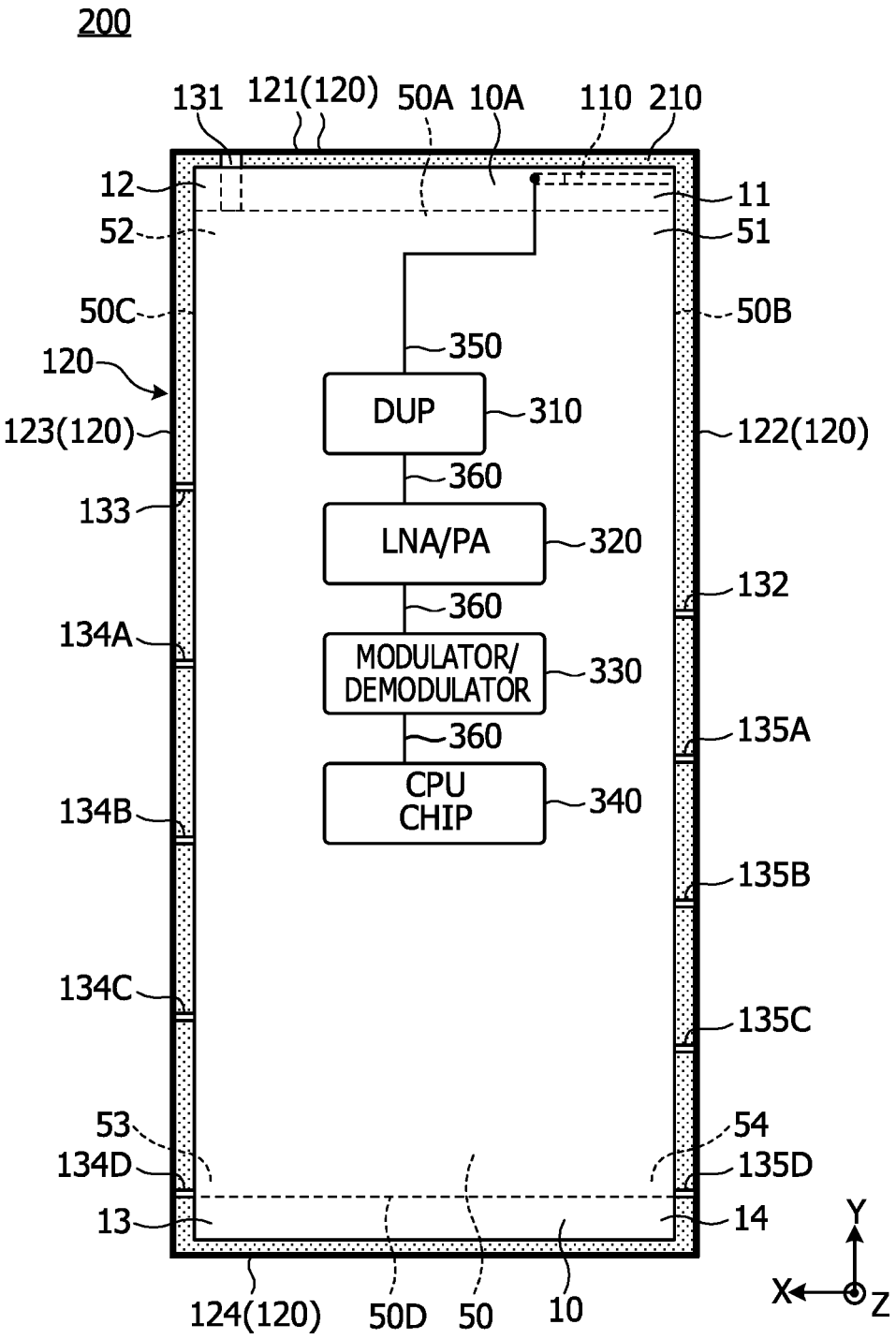
FIG. 2 is a diagram depicting the wireless communication device 200 including the antenna device 100 of the embodiment.
Figure 3:
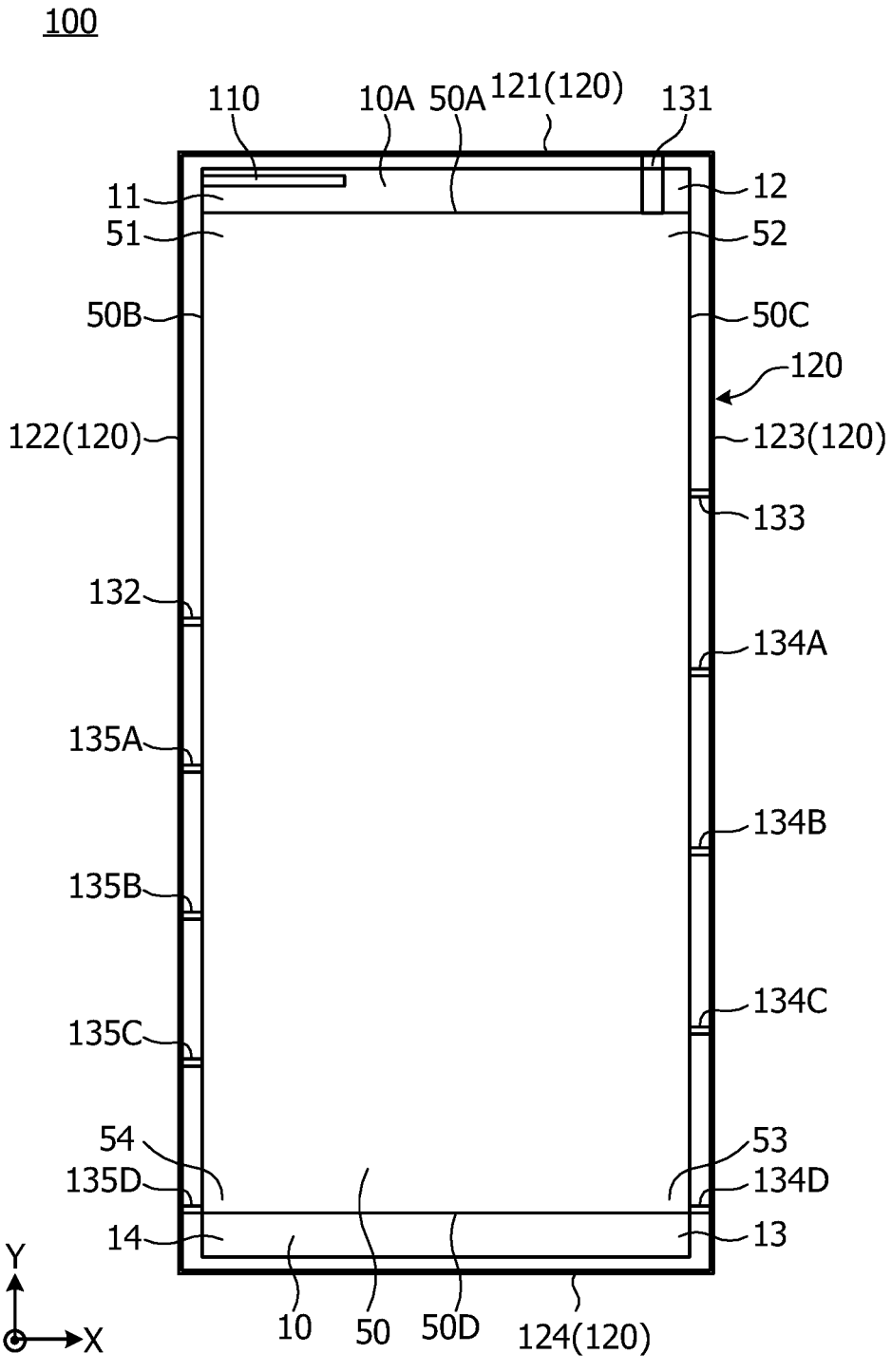
FIG. 3 is a diagram depicting the antenna device 100.
Figure 4:
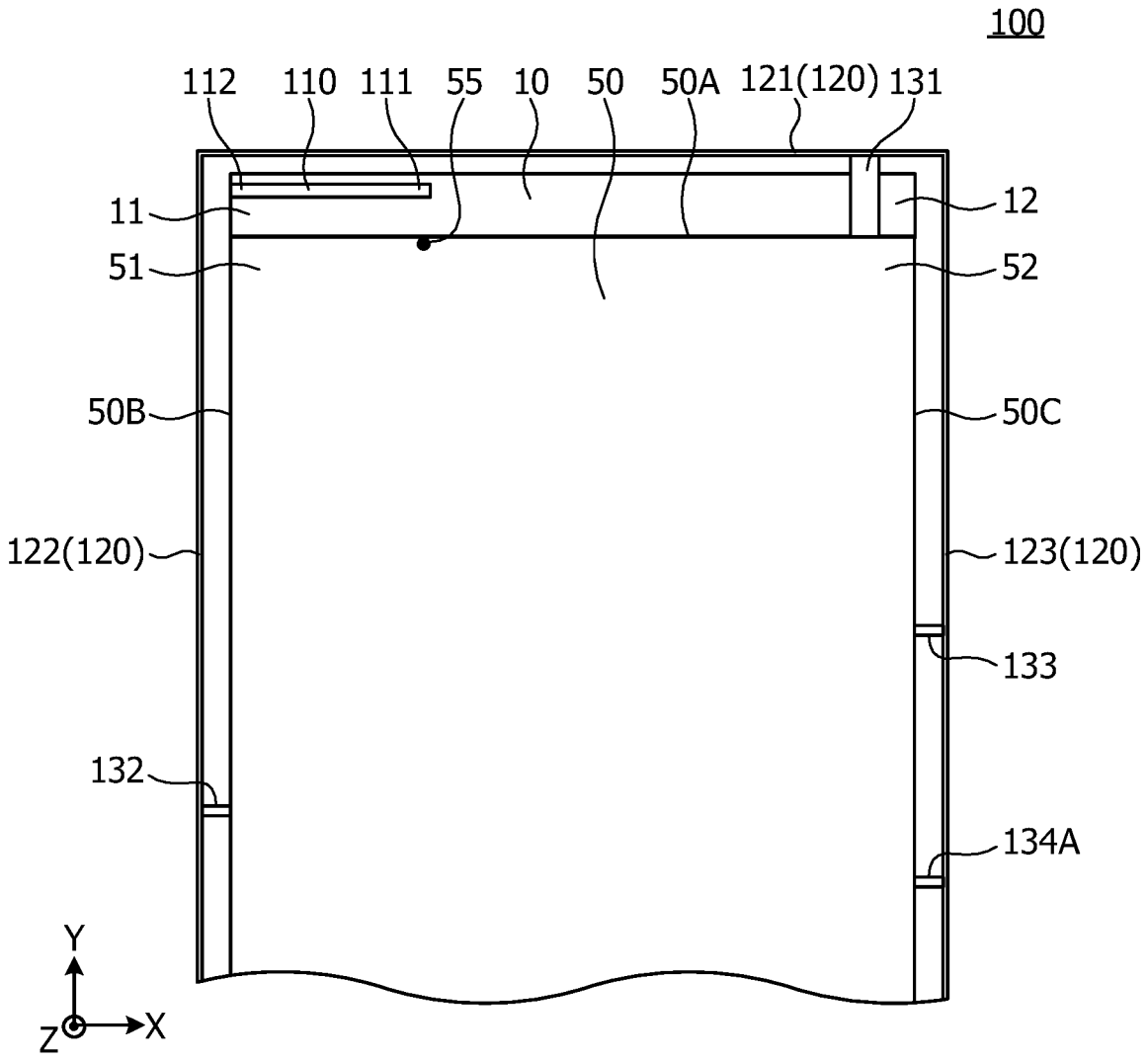
FIG. 4 is a plan view of the antenna device 100 in an enlarged manner.
Figure 5:
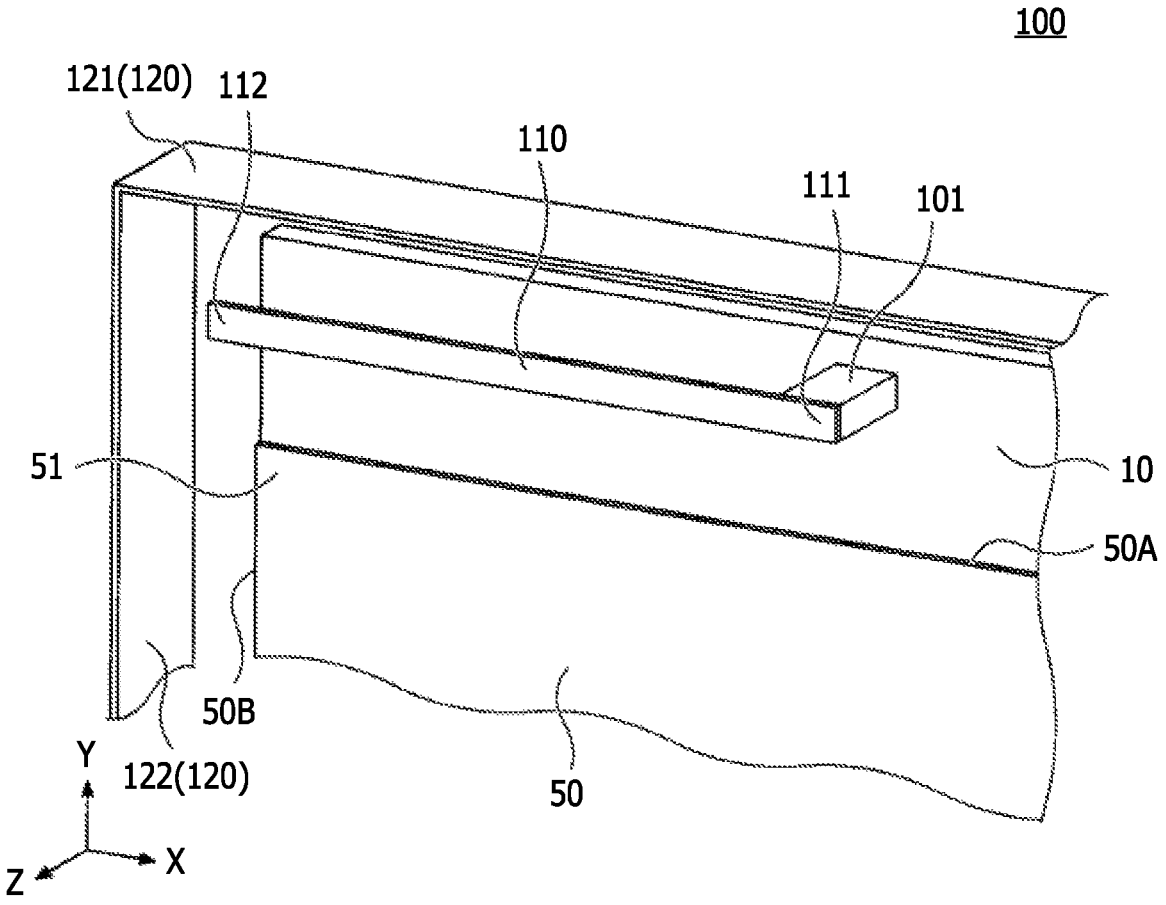
FIG. 5 is a perspective view of the antenna device 100 in an enlarged manner.

FIG. 1 and FIG. 2 are diagrams depicting a wireless communication device 200 including an antenna device 100 of an embodiment. FIG. 3 is a diagram depicting the antenna device 100. FIG. 4 and FIG. 5 are a plan view and a perspective view of the antenna device 100 in an enlarged manner. In the following, description is made by defining an XYZ coordinate system. Also, a planar view refers to an XY planar view.

The wireless communication device 200 includes a wiring substrate 10, the antenna device 100, a housing 210, a duplexer (DUP) 310, a low noise amplifier (LNA)/power amplifier (PA) 320, a modulator/demodulator 330, and a central processing unit (CPU) chip 340. The wireless communication device 200 is included in an electronic device such as, for example, a smartphone terminal or a tablet computer.

The antenna device 100 includes a ground plane 50, a contact spring 101, a power feeding element 110, a metal plate 120, and connection lines 131, 132, 133, 134A, 134B, 134C, 134D, 135A, 135B, 135C, and 135D.

The housing 210 depicted in FIG. 1 has a rectangular annular shape in a planar view, and is arranged so as to surround the outer periphery of the wiring substrate 10. In FIG. 1, the housing 210 is depicted in gray. The housing 210 is made of resin, and a positive direction side (right side) of the X axis and a negative direction side (left side) of the X axis are fixed in a state of being interposed by the ground plane 50 and the metal plate 120. In FIG. 1, although depiction is omitted, in a state in which an electronic device including the wireless communication device 200 is assembled, a cover is provided on a positive direction side of the Z axis of the ground plane 50, and is fixed to the housing 210. Also, when the electronic device including the wireless communication device 200 includes a display panel and/or touch panel, by way of example, the display panel and/or touch panel is arranged on a negative direction side of the Z axis of the wiring substrate 10.

Since the DUP 310, the LNA/PA 320, the modulator/demodulator 330, and the CPU chip 340 depicted in FIG. 2 are provided on a surface opposite to a surface where the antenna device 100 of the wiring substrate 10 is implemented, the position of the antenna device 100 is indicated by broken lines in FIG. 2.

Here, the DUP 310, the LNA/PA 320, the modulator/demodulator 330, and the CPU chip 340 are described first. The DUP 310, the LNA/PA 320, the modulator/demodulator 330, and the CPU chip 340 are connected via a wiring 360.

The DUP 310 is connected to the antenna device 100 via a wiring 350 and a via not depicted to perform switching between transmission and reception. Since the DUP 310 has a function as a filter, when the antenna device 100 receives signals of a plurality of frequencies, the signals of the respective frequencies may be separated inside.

The LNA/PA 320 amplifies power of transmission waves and reception waves. The modulator/demodulator 330 performs modulation of transmission waves and demodulation of reception waves. The CPU chip 340 has a function as a communication-purpose processor which performs communication process of the electronic device including the wireless communication device 200 and a function as an application processor which executes an application program. Note that the CPU chip 340 has an internal memory which stores data to be transmitted or data to be received and so forth.

Note that the wirings 350 and 360 are formed by, for example, patterning a copper foil on the surface of the wiring substrate 10. Also, although omitted in FIG. 2, a matching circuit for adjusting an impedance characteristic is provided between the antenna device 100 and the DUP 310.

Next, the antenna device 100 is described.

The wiring substrate 10 is, for example, a wiring substrate under flame retardant type 4 (FR-4) standards, and has an insulating layer 10A and the ground plane 50. The insulating layer 10A is, for example, a prepreg layer. The wiring substrate 10 may be configured to have a plurality of insulating layers 10A. On the outer periphery of the wiring substrate 10, the housing 210 and the metal plate 120 are provided.

The ground plane 50 is a metal layer arranged on a surface or inner layer of the wiring substrate 10. Here, by way of example, the ground plane 50 is provided on the back surface of the wiring substrate 10. The wiring substrate 10 has a rectangular shape in a planar view, and has vertexes 11, 12, 13, and 14. The ground plane 50 is not provided to an end on the Y axis positive direction side and an end on the Y axis negative direction side of the front surface of the wiring substrate 10 on the Z axis positive direction side, and the insulating layer 10A of the wiring substrate 10 is exposed.

The ground plane 50 is a metal layer retained at a ground potential, and is a rectangular metal layer having vertexes 51, 52, 53, and 54. The vertexes 51, 52, 53, and 54 are respectively positioned near the vertexes 11, 12, 13, and 14 of the wiring substrate 10. The ground plane 50 may be handled as a ground layer, a grounding plate, or a bottom board.

The ground plane 50 has edge sides 50A, 50B, 50C, and 50D. The edge side 50A is a side connecting the vertexes 51 and 52, the edge side 50B is a side connecting the vertexes 51 and 54, the edge side 50C is a side connecting the vertexes 52 and 53, and the edge side 50D is a side connecting the vertexes 53 and 54. The edge sides 50A and 50D are positioned to be offset from an edge side of the wiring substrate 10 on the Y axis positive direction side (edge side between the vertexes 11 and 12) and an edge side thereof on the Y axis negative direction side (edge side between the vertexes 13 and 14). Thus, the insulating layer 10A of the wiring substrate 10 is exposed on the Y axis positive direction side and the Y axis negative direction side of the edge sides 50A and 50D. Also, the edge sides 50B and 50C are at the substantially same positions as those of an edge side of the wiring substrate 10 on the X axis positive direction side (edge side between the vertexes 12 and 13) and an edge side thereof on the X axis negative direction side (edge side between the vertexes 11 and 14).

Also, on the edge side 50A of the ground plane 50, a point corresponding to a power feeding point 111 of the power feeding element 110 in the X axis direction (hereinafter referred to as a ground point 55) is a point to which a shield line of a coaxial cable is connected when a core wire of the coaxial cable is connected to the power feeding point of the power feeding element 110, for example.

Note that while the ground plane 50 with the edge sides 50A, 50B, 50C, and 50D each being linear is depicted herein, any edge side may not be linear, for example, with asperities provided so as to match the internal shape of the housing of the electronic device including the antenna device 100, or the like.

The contact spring 101 is arranged on the front surface of the insulating layer 10A to connect the power feeding point 111 of the power feeding element 110 and the via penetrating through the insulating layer 10A. The via penetrating through the insulating layer 10A is connected to the wiring 350. The spring of the contact spring 101 itself is surrounded by the resin-made housing, and is not viewable from outside.

The power feeding element 110 has the power feeding point 111 and an open end 112. The power feeding element 110 is a linear power feeding element extending along the line 121 of the metal plate 120 from the power feeding point 111 along the open end 112. The power feeding element 110 extends to the X axis direction in parallel with the line 121, and is electromagnetic-field-coupled to the line 121. The power feeding element 110 is provided to feed power to the metal plate 120. Note that the power feeding element 110 may be handled as an antenna element.

The metal plate 120 is a metal member in a rectangular annular shape in a planar view having lines 121, 122, 123, and 124. Each of the lines 121, 122, 123, and 124 is a thin-plate-shaped, narrowly-elongated metal member, with a longitudinal direction being in a direction in which a side surface is viewable in a planar view (X axis direction or Y axis direction).

The lines 121, 122, 123, and 124 are respectively arranged so as to be opposed to the edge side between the vertexes 11 and 12, the edge side between vertexes 11 and 14, the edge side between the vertexes 12 and 13, and the edge side between the vertexes 13 and 14 of the wiring substrate 10. The lines 121, 122, 123, and 124 are connected in a rectangular annular shape in a clockwise direction in the order of the lines 121, 123, 124, and 122 in a planar view.

The metal plate 120 is arranged so as to surround the outer periphery of the wiring substrate 10, and has a role in reinforcing the housing 210 and a role in functioning as a radiation element in cooperation with the power feeding element 110. The metal plate 120 is one example of a metal member.

The line 121 extends to the X axis direction on the Y axis positive direction side of the wiring substrate 10, and is connected to the edge side 50A of the ground plane 50 by the connection line 131. Also, the lines 122 and 123 are connected to both ends of the line 121.

A location where the connection line 131 is connected to the line 121 is a side near an end of the line 121 on the X axis positive direction side (a point of connection with the line 123). Also, on a side near an end on the X axis negative direction side (a point of connection with the line 122), the line 121 is arranged in parallel with the power feeding element 110.

A space in the Y axis direction between the line 121 and the power feeding element 110 is a space to the extent that electromagnetic field coupling occurs between the power feeding element 110 and the line 121 when power is fed to the power feeding element 110. The line 121 is fed with power by the power feeding element 110. Note that feeding the line 121 with power by the power feeding element 110 is synonymous with feeding at least part of the metal plate 120 with power by the power feeding element 110.

The line 122 extends to the Y axis direction on the X axis negative direction side of the wiring substrate 10, and is connected to the edge side 50B of the ground plane 50 by the connection lines 132, 135A, 135B, 135C, and 135D. Also, the lines 121 and 124 are connected to both ends of the line 122.

The positions of the connection lines 132, 135A, 135B, 135C, and 135D are defined based on a relation between the line 121 and the connection line 131 and a relation between the line 123 and the connection line 133. Details about the positions of the connection lines 132, 135A, 135B, 135C, and 135D will be described further below.

The line 123 extends to the Y axis direction on the X axis positive direction side of the wiring substrate 10, and is connected to the edge side 50C of the ground plane 50 by the connection lines 133, 134A, 134B, 134C, and 134D. Also, the lines 121 and 124 are connected to both ends of the line 123.

The positions of the connection lines 133, 134A, 134B, 134C, and 134D are defined based on a relation between the line 121 and the connection line 131 and a relation between the line 122 and the connection line 132. Details about the positions of the connection lines 133, 134A, 134B, 134C, and 134D will be described further below.

The line 124 extends to the X axis direction on the Y axis negative direction side of the wiring substrate 10, and has the wirings 122 and 123 connected to both ends. The line 124 is retained by the lines 122 and 123, and has not connected thereto connection lines such as the connection lines 131, 132, and 133.

The connection line 131 extends from the edge side 50A to the Y axis positive direction on a side near the vertex 52 (X axis positive direction side) rather than the vertex 51 of the ground plane 50, and is connected to the line 121. The connection line 131 is one example of a first connection line.

When power is fed to the power feeding element 110, a loop current flows through the connection line 131, the line 121, the power feeding element 110, and the edge side 50A (a portion between the ground point 55 and a connection point between the ground plane 50 and the connection line 131). This is because the power feeding element 110 and mainly the lines 121 and 122 of the metal plate 120 are electromagnetic-field-coupled, the power feeding point 111 is connected to the core wire of the coaxial cable, and the ground point 55 is connected to the shield line of the coaxial cable, thereby causing a loop to occur in an alternating manner.

Thus, the distance between the ground point 55 and the connection point between the ground plane 50 and the connection line 131 is set at a distance represented by a length of ½ of the electrical length of the wavelength at a frequency f4. Here, as described above, the edge side 50A of the ground plane 50 may not be linear. Also in this case, it is only required that the distance between the ground point 55 and the connection point between the ground plane 50 and the connection line 131 is set at a distance represented by a length (4/2), which is ½ of the electrical length of a wavelength 4 at the frequency f4. Note that the frequency f4 is, by way of example, 2.4 GHz, and is a frequency higher than frequencies f1, f2, and f3, which will be described further below.

The length (4/2), which is ½ of the electrical length of the wavelength 4 at the frequency f4, is one example of a length corresponding to a length of ½ of the wavelength 4 at the frequency f4.

The connection line 132 constructs a loop antenna in cooperation with the connection line 131, the lines 121 and 122 of the metal plate 120, the edge side 50A, and the edge side 50B. The connection line 132 is one example of a second connection line.

Here, the length of the loop constructed of the connection lines 131 and 132, the lines 121 and 122 of the metal plate 120, the edge side 50A, and the edge side 50B is an electrical length (1) of a wavelength at the frequency f1, and is also a length which is a double of the electrical length (2) of a wavelength at the frequency f2 which is double of the frequency f1. This loop is one example of a first loop.

To construct a loop antenna which resonates at the frequency f1, the length of the metal plate 120 between the connection line 131 and the connection line 132 is set at a length (½), which is ½ of the electrical length of the wavelength 1 at the frequency f1. The frequency f1 is, by way of example, 0.85 GHz, which is a frequency lower than the frequencies f2, f3, and f4.

The length (½), which is ½ of the electrical length (1) of the wavelength at the frequency f1, is one example of a length corresponding to ½ of a first wavelength at the frequency f1.

Note that the length of the metal plate 120 between the connection line 131 and the connection line 132 is a length between a connection point where the metal plate 120 (line 121) is connected to the connection line 131 and a connection point where the metal plate 120 (line 122) is connected to the connection line 132, but may include at least part of the length of the connection line 131 and/or the connection line 132.

To construct a loop antenna which resonates at the frequency f2, the length of the metal plate 120 between the connection line 131 and the connection line 132 is set at an electrical length (2) of the wavelength 2 at a frequency f2. The frequency f2 is, by way of example, 1.65 GHz, which is a frequency lower than the frequencies f3 and f4.

The electrical length (2) of the wavelength at the frequency f2 is one example of a length corresponding to a second wavelength at a second frequency.

The connection line 133 constructs a loop antenna in cooperation with the connection line 131, the lines 121 and 123 of the metal plate 120, the edge side 50A, and the edge side 50C. The connection line 133 is one example of a third connection line.

This is because when power is fed to the power feeding element 110, a current flows through the line 121 of the metal plate 120 and the connection line 131, and thus flows also through the loop including the connection lines 131 and 133. This loop is one example of a second loop.

Here, the length of the loop constructed of the connection lines 131 and 133, the lines 121 and 123 of the metal plate 120, the edge side 50A, and the edge side 50C is an electrical length (3) of a wavelength at the frequency f3.

To construct a loop antenna which resonates at the frequency f3, the length of the metal plate 120 between the connection line 131 and the connection line 133 is set at a length (3/2), which is ½ of the electrical length of the wavelength 3 at the frequency f3. The frequency f3 is, by way of example, 2.0 GHz.

Also, the length (3/2), which is ½ of the electrical length of the wavelength 3 at the frequency f3, is one example of a length corresponding to ½ of a third wavelength at a third frequency.

Note that the length of the metal plate 120 between the connection line 131 and the connection line 133 is a length between a connection point where the metal plate 120 (line 121) is connected to the connection line 131 and a connection point where the metal plate 120 (line 123) is connected to the connection line 133, but may be thought to include at least part of the length of the connection line 131 and/or the connection line 133.

The connection lines 134A, 134B, 134C, and 134D are provided on the Y axis negative direction side of the connection line 133 in this order so as to connect between the edge side 50C of the ground plane 50 and the line 123 of the metal plate 120.

The position of the connection line 134A is set so that the length of a loop constructed of the connection line 133, the connection line 134A, the line 123 of the metal plate 120, and the edge side 50C is shorter than the electrical length (3) of the wavelength 4 at the highest frequency f4 among the frequencies f1, f2, f3, and f4.

In other words, the length between the connection line 134A and the connection line 133 of the metal plate 120 is set so as to be shorter than the length (4/2), which is ½ of the electrical length of the wavelength 4 at the frequency f4.

This is to restrain resonance adjacent to the frequencies f1, f2, f3, and f4 from occurring in the loop constructed of the connection line 133, the connection line 134A, the line 123 of the metal plate 120, and the edge side 50C. For example, when resonance adjacent to a band at the frequency f4 occurs, the characteristic at the frequency f4 itself may be degraded. The same goes for the frequencies f1, f2, and f3.

Note that it is only required that the positions of the connection lines 134B, 134C, and 134D are set so that the length of the metal plate 120 between each of these connection lines 134B, 134C, and 134D and its relevant one of the connection lines 134A, 134B, and 134C adjacent on the Y axis positive direction side is shorter than the length (4/2), which is ½ of the electrical length of the wavelength 4 at the frequency f4. However, as compared with the connection line 134A, the connection lines 134B, 134C, and 134D are positioned further away from the connection line 133. Therefore, the positional constraint as described above may not be provided if there is no possibility of occurrence of characteristic degradation due to occurrence of resonance.

The connection lines 135A, 135B, 135C, and 135D are provided on the Y axis negative direction side of the connection line 132 in this order so as to connect between the edge side 50B of the ground plane 50 and the line 122 of the metal plate 120.

The position of the connection line 135A is set so that the length of a loop constructed of the connection line 132, the connection line 135A, the line 122 of the metal plate 120, and the edge side 50B is shorter than the electrical length (3) of the wavelength 4 at the highest frequency f4 among the frequencies f1, f2, f3, and f4.

In other words, the length between the connection line 135A and the connection line 132 of the metal plate 120 is set so as to be shorter than the length (4/2), which is ½ of the electrical length of the wavelength 4 at the frequency f4. The reason for this is similar to the reason for setting the position of the connection line 134A with respect to the connection line 133. The positions of the connection lines 135B, 135C, and 135D is also set in a similar manner as for the positions of the connection lines 134B, 134C, and 134D.

Figure 6:
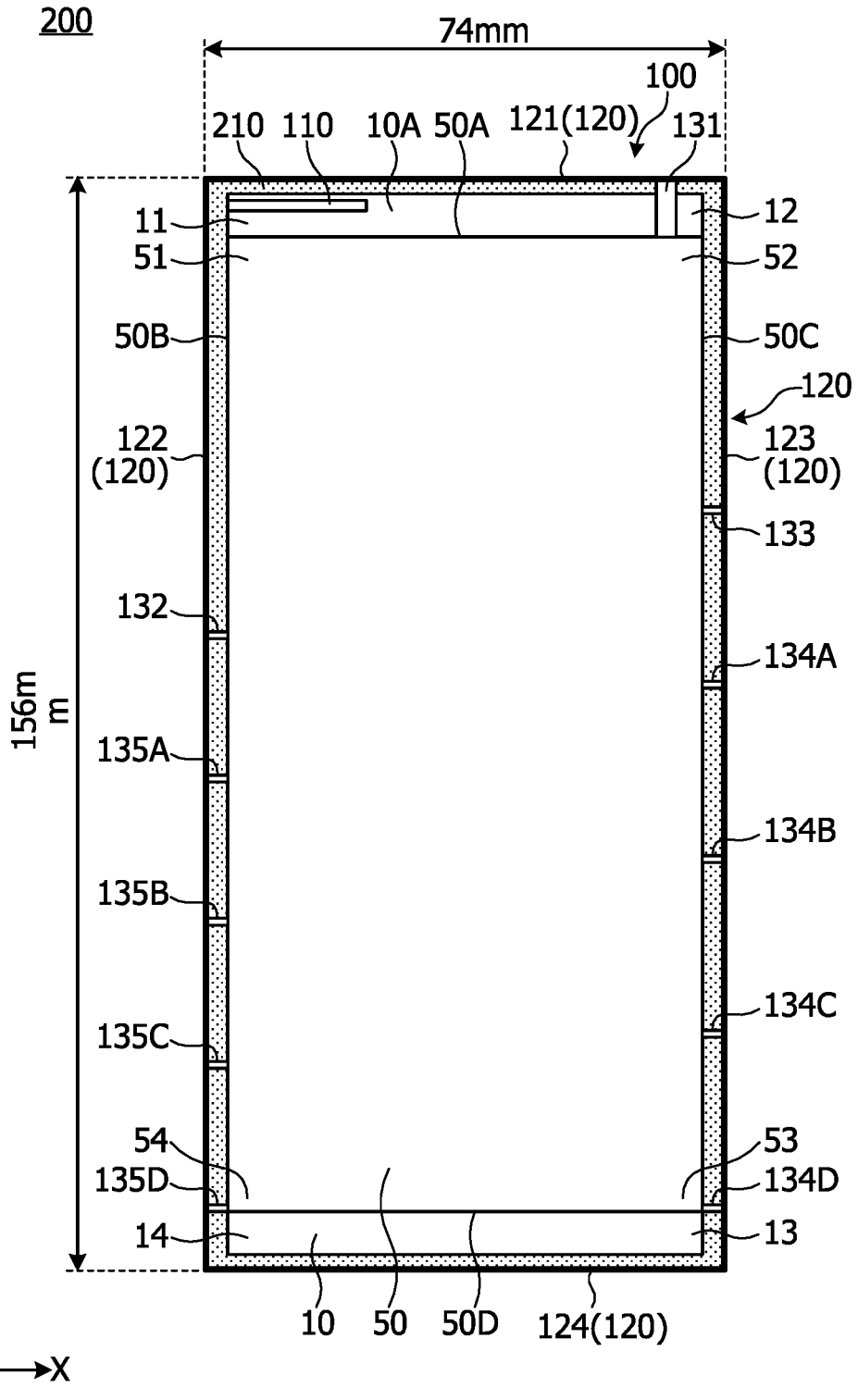
FIG. 6 is a diagram depicting dimensions of each unit of the wireless communication device 200 including the antenna device 100 of the embodiment.
Figure 7:
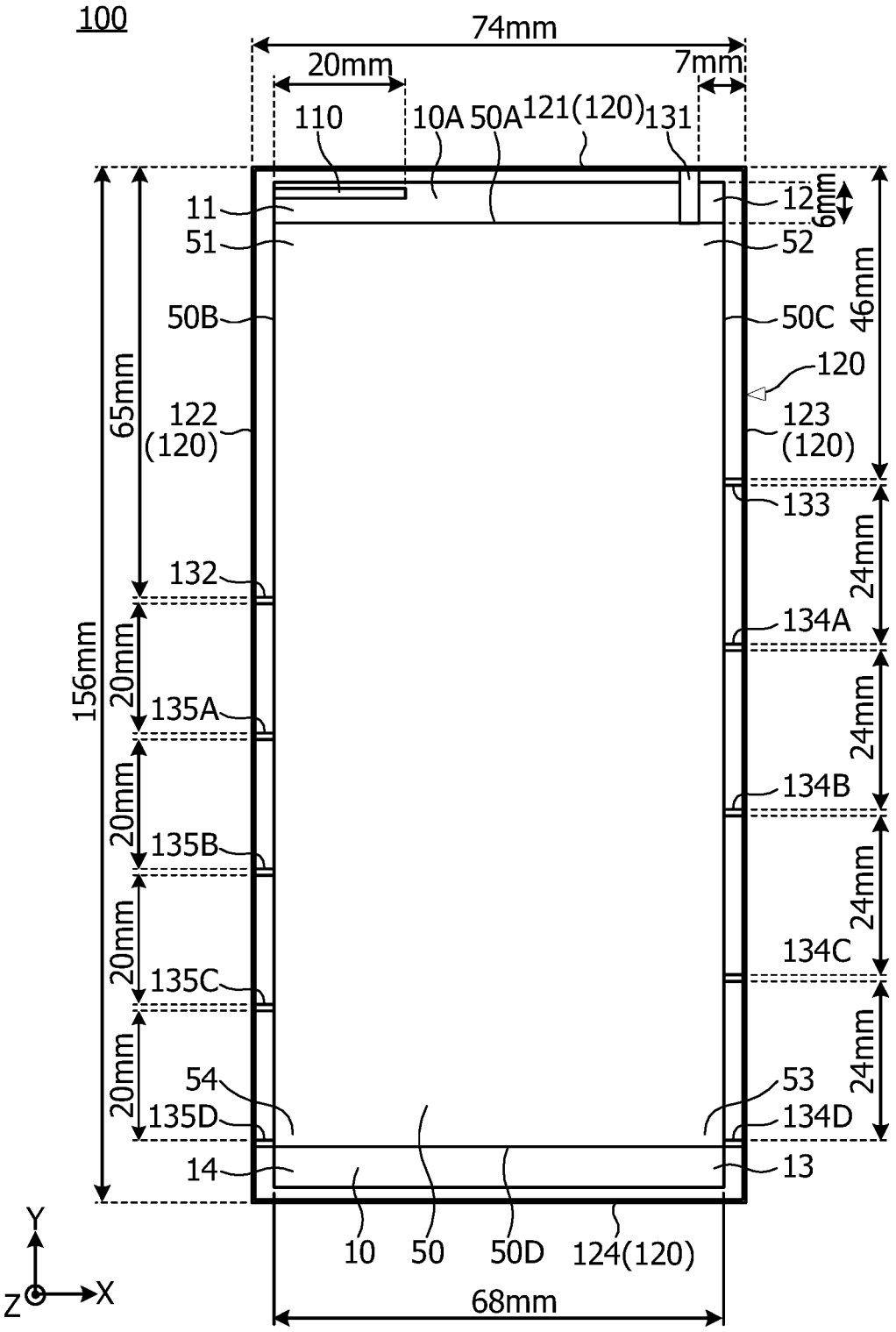
FIG. 7 is a diagram depicting dimensions of each unit of the antenna device 100 of the embodiment.

FIG. 6 and FIG. 7 are diagrams depicting dimensions of each unit of the wireless communication device 200 including the antenna device 100 of the embodiment.

As depicted in FIG. 6, the length of the metal plate 120 in the X axis direction (the length of each of the lines 121 and 124) is 74 mm. The length of the metal plate 120 in the Y axis direction (the length of each of the lines 122 and 123) is 156 mm. Also, the width of the metal plate 120 in the Z axis direction is 4.5 mm.

As depicted in FIG. 7, the length of the power feeding element 110 in the X axis direction is 20 mm. The length of the connection line 131 in the Y axis direction is 9 mm. The length of the line 121 on the X axis positive direction side of the connection line 131 is 7 mm.

The length of the metal plate 120 between a joint part between the lines 121 and 123 and the connection line 133 is 46 mm. The length of the metal plate 120 between the connection lines 133 and 134A is 24 mm. The length of the metal plate 120 between the connection lines 134A and 134B, the length thereof between the connection lines 134B and 134C, and the length thereof between the connection lines 134C and 134D are 24 mm each.

The length of the metal plate 120 between a joint part between the lines 121 and 122 and the connection line 132 is 65 mm. The length of the metal plate 120 between the connection lines 132 and 135A, the length thereof between the connection lines 135A and 135B, the length thereof between the connection lines 135B and 135C, and the length thereof between the connection lines 135C and 135D are 20 mm each. Also, the width of the ground plane 50 in the X axis direction is 68 mm.

Figure 8:
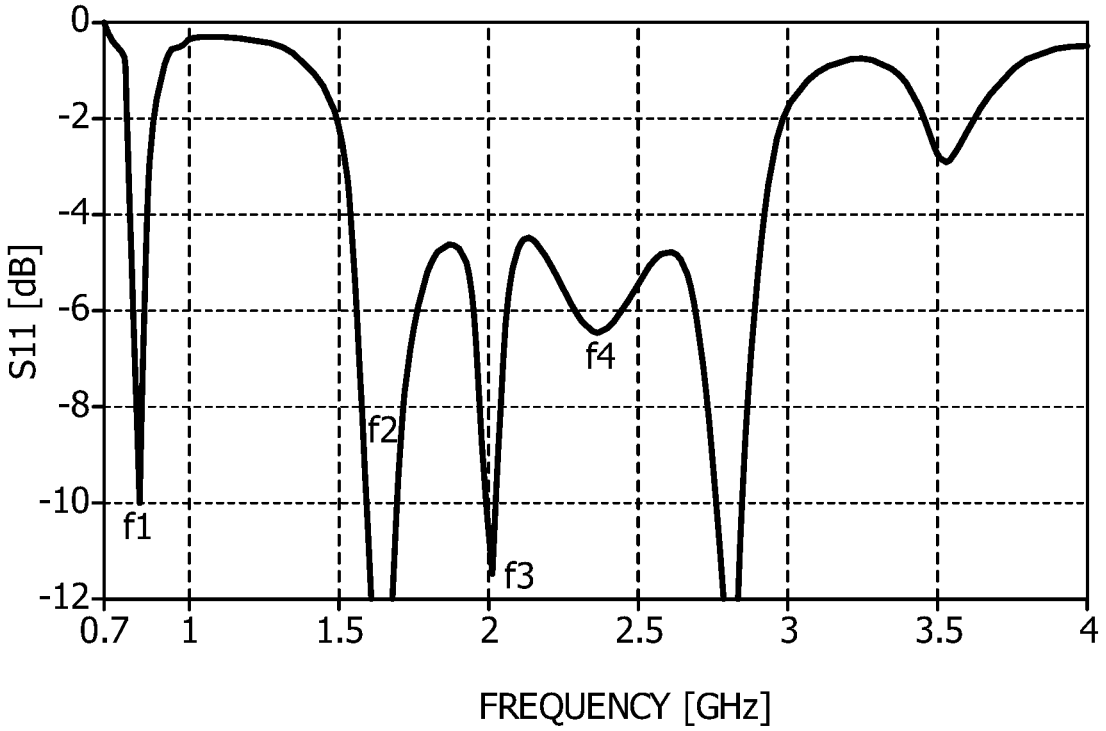
FIG. 8 is a diagram depicting a frequency characteristic of an S11 parameter of the antenna device 100.
Figure 9:
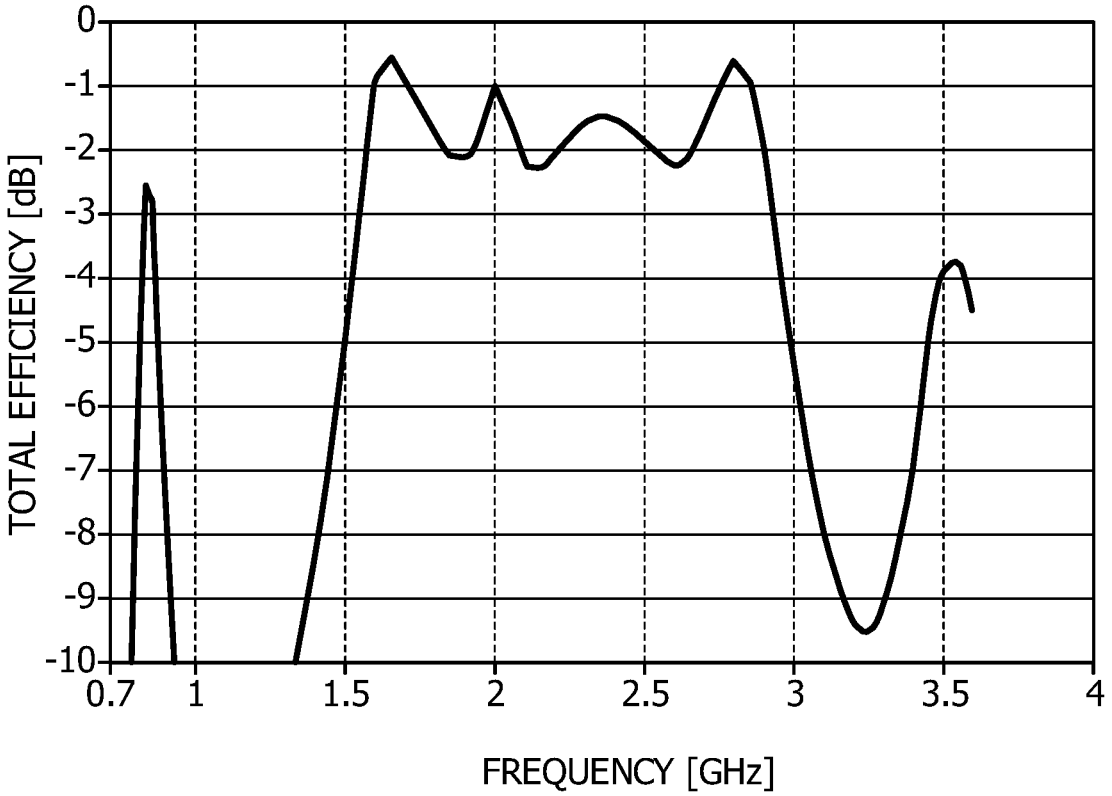
FIG. 9 is a diagram depicting a frequency characteristic of total efficiency of the antenna device 100.

FIG. 8 is a diagram depicting a frequency characteristic of an S11 parameter of the antenna device 100. FIG. 9 is a diagram depicting a frequency characteristic of total efficiency of the antenna device 100. FIG. 8 and FIG. 9 depict results acquired from electromagnetic field simulations.

As depicted in FIG. 8, in the frequency characteristic of the S11 parameter, it was found that the S11 parameter is equal to or lower than −6 dB at frequencies f1 (0.85 GHz), f2 (1.65 GHz), f3 (2.0 GHz), and f4 (2.4 GHz), allowing a favorable radiation characteristic with less radiation to be acquired.

Also as depicted in FIG. 9, in the frequency characteristic of total efficiency, it was found that total efficiency is equal to or higher than −3 dB at the frequencies f1 (0.85 GHz), f2 (1.65 GHz), f3 (2.0 GHz), and f4 (2.4 GHz), allowing a favorable radiation characteristic to be acquired.

FIG. 10 to FIG. 13 are diagrams each depicting a current distribution of the antenna device 100. The current distributions of FIG. 10 to FIG. 13 have been acquired from electromagnetic field simulations, and each depict a current distribution at the frequencies f1 (0.85 GHz), f2 (1.65 GHz), f3 (2.0 GHz), and f4 (2.4 GHz). Note that each current distribution represents that the current density is higher as the current distribution is blacker (thicker) and the current density is lower as the current distribution is whiter (thinner).

Figure 10:
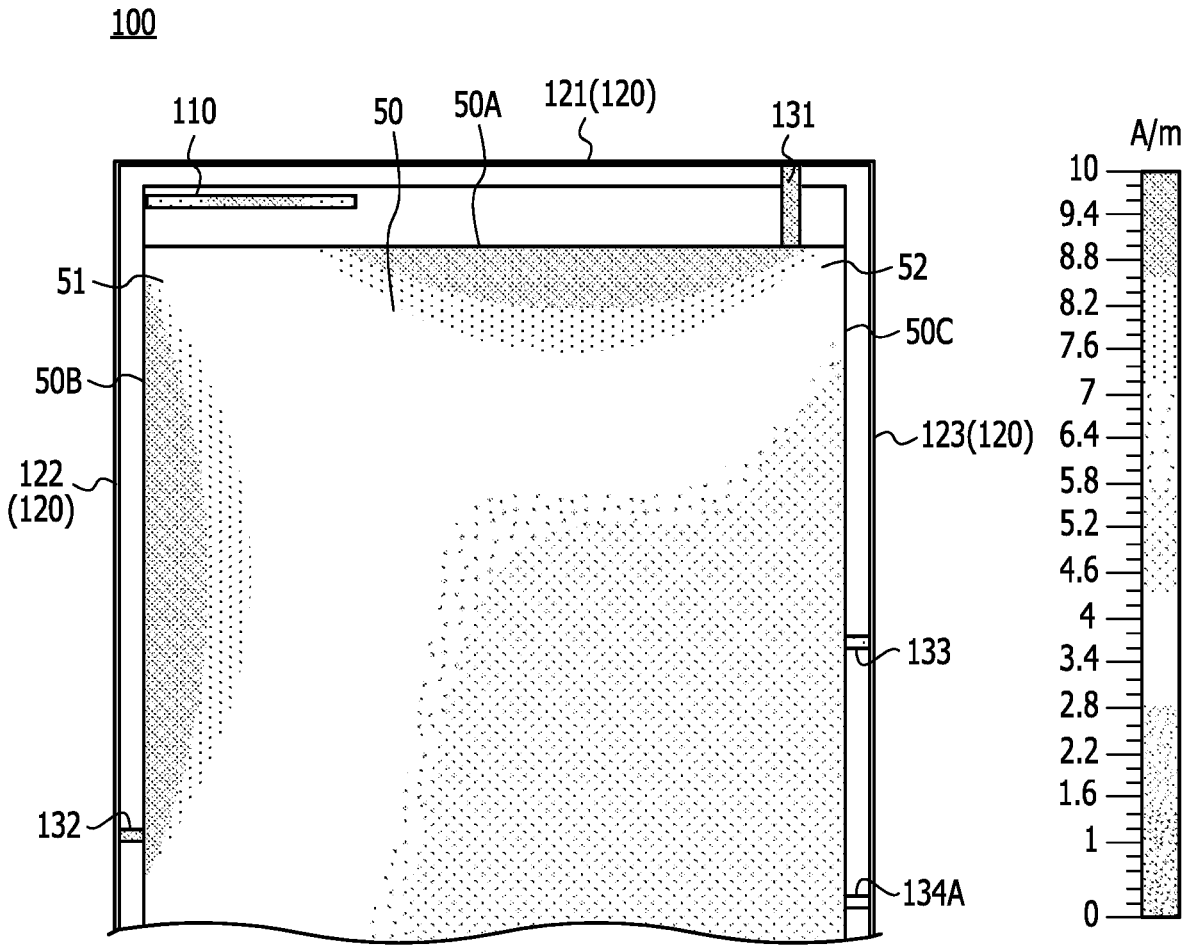
FIG. 10 is a diagram depicting a current distribution of the antenna device 100.

At the frequency f1 (0.85 GHz) depicted in FIG. 10, it is found that a current flows through the power feeding element 110 and flows through a loop constructed of the connection line 131, the line 121, the line 122, the connection line 132, the edge side 50B, and the edge side 50A. In particular, since current density of the connection lines 131 and 132 is high, it is found that antinodes of resonance current occur at two locations, that is, the connection lines 131 and 132. Also, since current density of a connection part between the lines 121 and 122 and the vertex 51 is low, it is found that nodes of resonance current occur at two locations, that is, the connection part between the lines 121 and 122 and the vertex 51.

That is, from the current distribution depicted in FIG. 10, it is found that resonance for one wavelength occurs in the loop constructed of the connection line 131, the line 121, the line 122, the connection line 132, the edge side 50B, and the edge side 50A. In other words, it is found that a portion having the length (½), which is ½ of the electrical length of the wavelength 1 at the frequency f1, extends between the connection line 131 and the connection line 132 of the metal plate 120.

Figure 11:
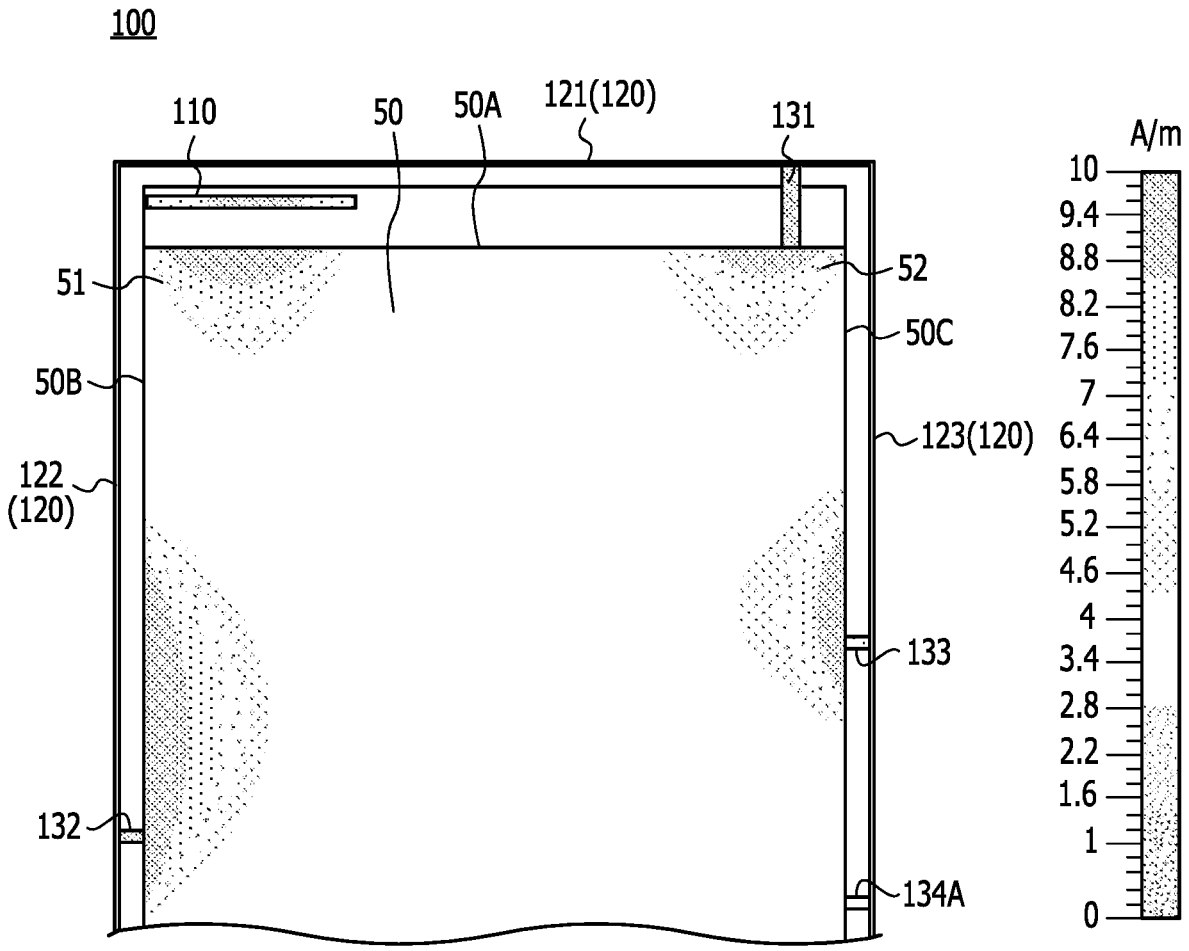
FIG. 11 is a diagram depicting a current distribution of the antenna device 100.

At the frequency f2 (1.65 GHz) depicted in FIG. 11, it is found that a current flows through the power feeding element 110 and flows through the loop constructed of the connection line 131, the line 121, the line 122, the connection line 132, the edge side 50B, and the edge side 50A. In particular, since current density of the connection lines 131 and 132, the connection part between the lines 121 and 122, and the vertex 51 is high, it is found that antinodes of resonance current occur at four locations, that is, the connection lines 131 and 132, the connection part between the lines 121 and 122, and the vertex 51, and also current density is low and nodes of resonance current occur at four locations between these.

That is, from the current distribution depicted in FIG. 11, it is found that resonance for two wavelengths occurs in the loop constructed of the connection line 131, the line 121, the line 122, the connection line 132, the edge side 50B, and the edge side 50A. In other words, it is found that a portion having the electrical length (2) of the wavelength 2 at the frequency f2 extends between the connection line 131 and the connection line 132 of the metal plate 120.

From FIG. 10 and FIG. 11, it was confirmed that resonance for one wavelength and resonance for two wavelengths occur in the loop constructed of the connection line 131, the line 121, the line 122, the connection line 132, the edge side 50B, and the edge side 50A and resonance at the frequency f1 (0.85 GHz) and the frequency f2 (1.65 GHz), which is approximately double the frequency f1, occurs.

Figure 12:
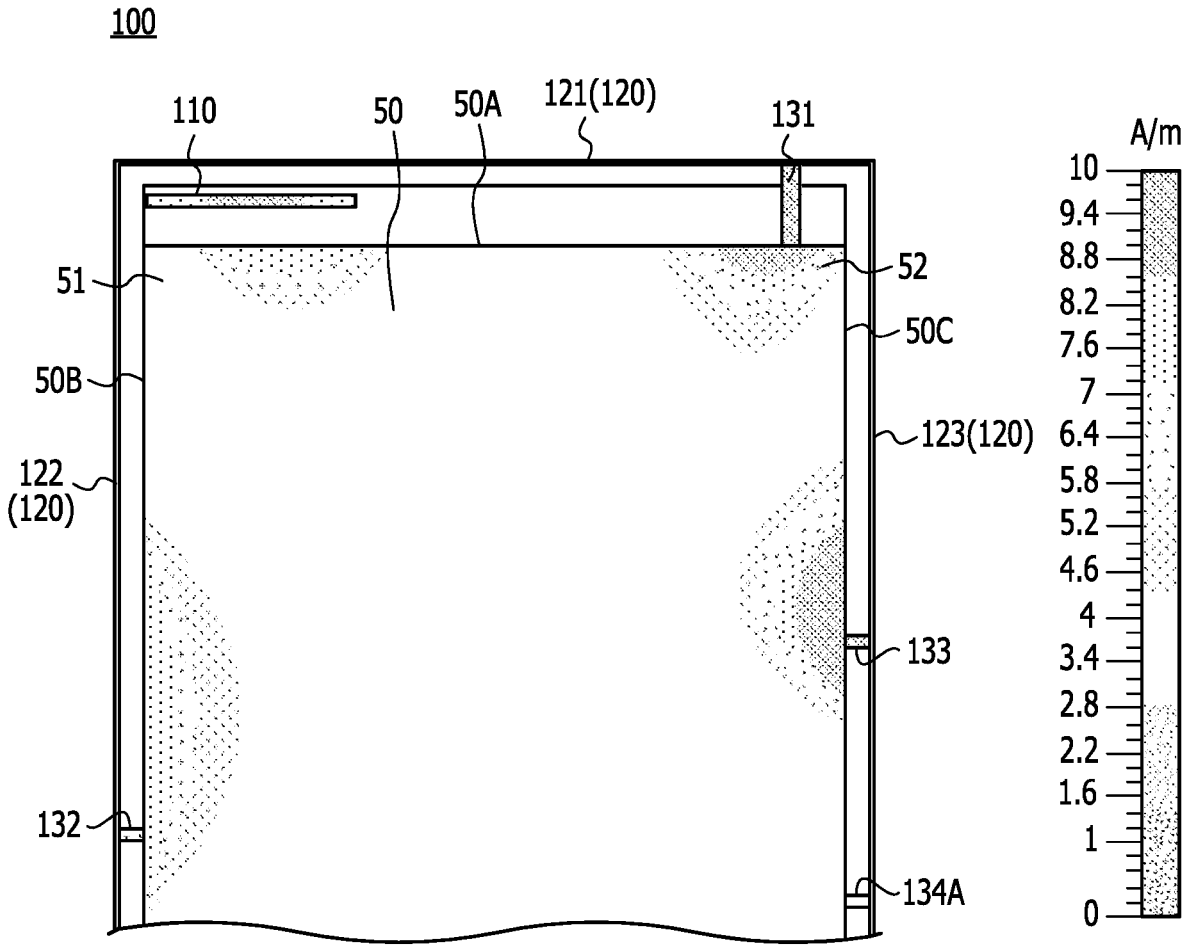
FIG. 12 is a diagram depicting a current distribution of the antenna device 100.

At the frequency f3 (2.0 GHz) depicted in FIG. 12, it is found that a current flows through the power feeding element 110 and flows through a loop constructed of the connection line 131, the line 121, the line 123, the connection line 133, the edge side 50C, and the edge side 50A. In particular, since current density of the connection lines 131 and 133 is high, it is found that antinodes of resonance current occur at two locations, that is, the connection lines 131 and 133. Also, since current density of a portion between the antinodes at the two locations is low, it is found that two antinodes and two nodes of resonance current occur.

That is, from the current distribution depicted in FIG. 12, it is found that resonance for one wavelength occurs in the loop constructed of the connection line 131, the line 121, the line 123, the connection line 133, the edge side 50C, and the edge side 50A. In other words, it is found that a portion having the length (3/2), which is ½ of the electrical length of the wavelength 3 at the frequency f3, extends between the connection line 131 and the connection line 132 of the metal plate 120.

Figure 13:
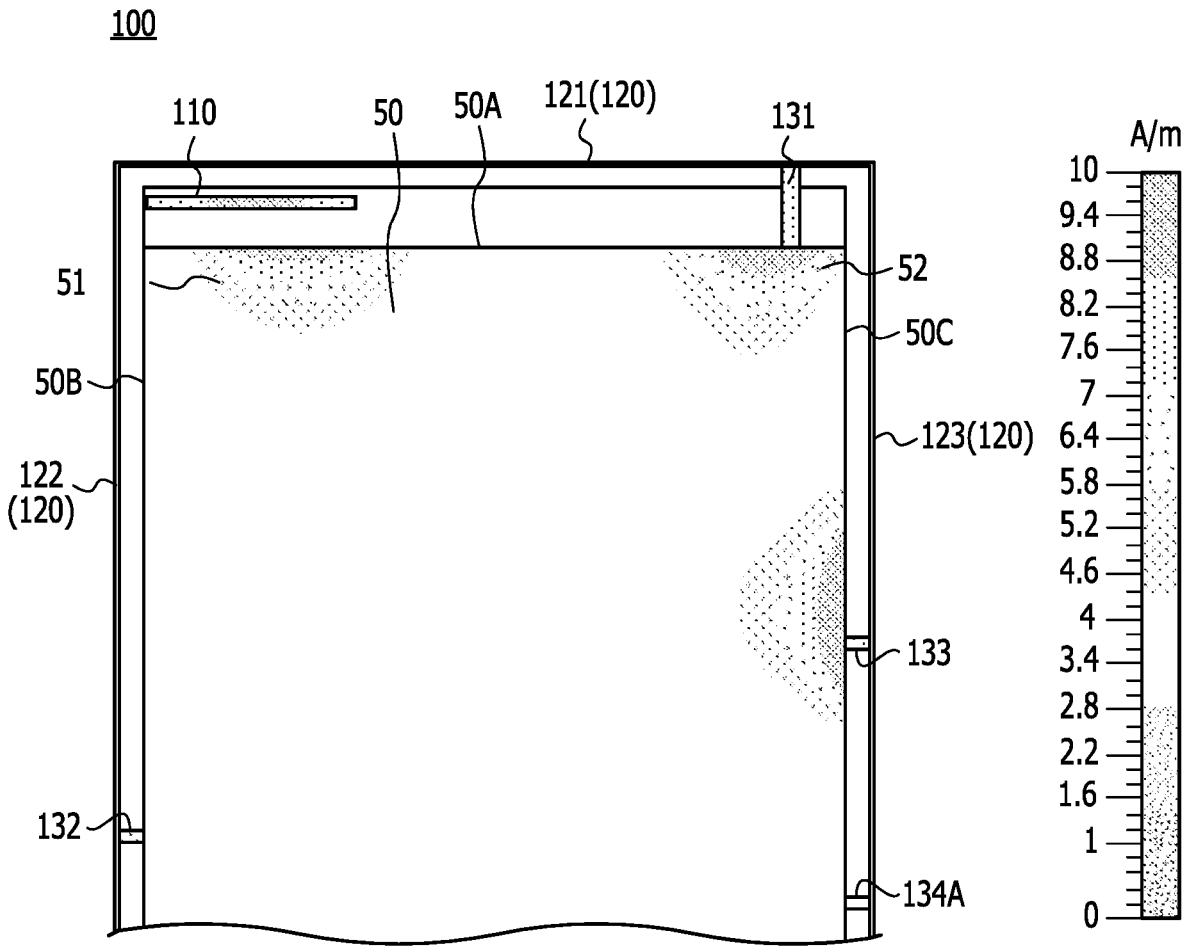
FIG. 13 is a diagram depicting a current distribution of the antenna device 100.

At the frequency f4 (2.4 GHz) depicted in FIG. 13, it is found that a current flows through the power feeding element 110 and a loop current flows through the line 121, the connection line 131, the edge side 50A, and the power feeding element 110. In particular, since current density of the power feeding element 110 and the connection line 131 is high, it is found that antinodes of resonance current occur at two locations, that is, the power feeding element 110 and the connection line 131. Also, since current density of a portion between the antinodes at the two locations is low, it is found that two antinodes and two nodes of resonance current occur.

That is, from the current distribution depicted in FIG. 13, it is found that resonance for one wavelength occurs in the loop-shaped portion constructed of the line 121, the connection line 131, the edge side 50A, and the power feeding element 110. In other words, it is found that a portion having the length (4/2), which is ½ of the electrical length of the wavelength 4 at the frequency f4, extends in a portion of the edge side 50A between the power feeding element 110 and the connection line 131.

Figure 14:
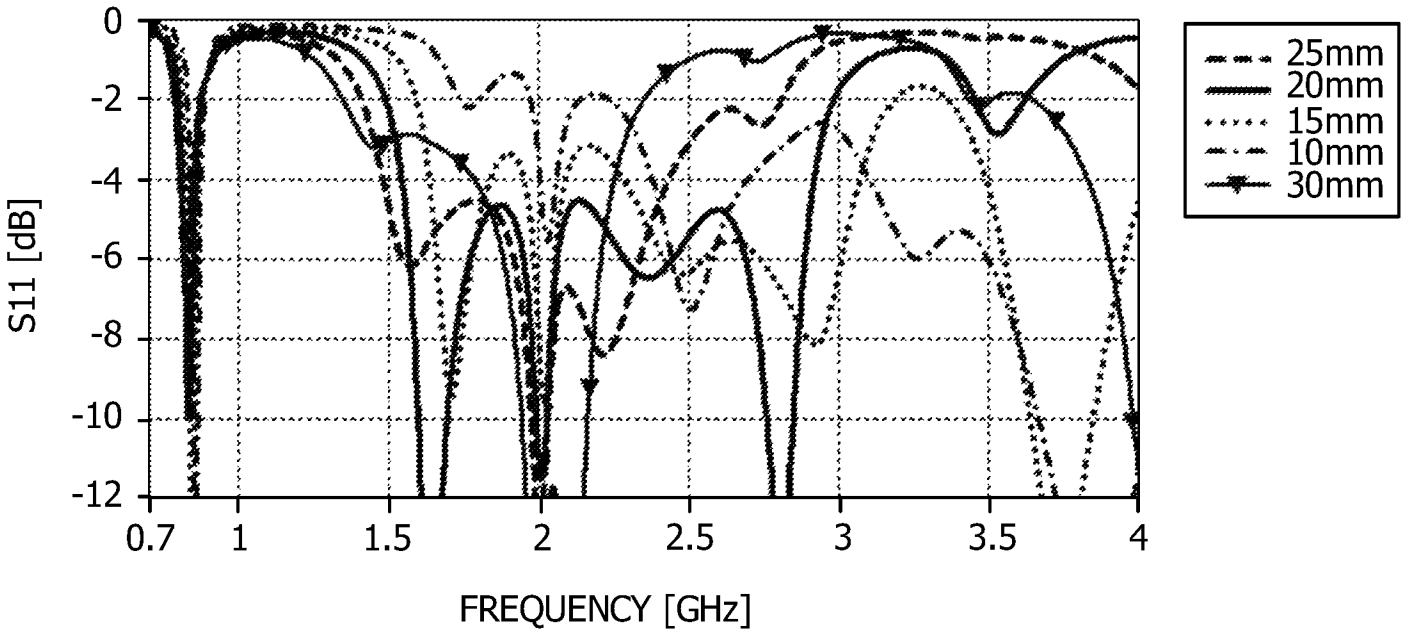
FIG. 14 is a diagram depicting dependency of frequency characteristics of the S11 parameter with respect to the length of a power feeding element 110.

FIG. 14 is a diagram depicting dependency of frequency characteristics of the S11 parameter with respect to the length of the power feeding element 110. Here, in a simulation, frequency characteristics of the S11 parameter are described when the length of the power feeding element 110 is set at 10 mm, 15 mm, 20 mm, 25 mm, and 30 mm by changing the position of the power feeding point 111, with the position of the open end 112 of the power feeding element 110 being fixed.

When the length of the power feeding element 110 is 15 mm, 20 mm, and 25 mm, substantially favorable values were acquired at the frequencies f1 (0.85 GHz), f2 (1.65 GHz), f3 (2.0 GHz), and f4 (2.4 GHz). However, when the length of the power feeding element 110 is 10 mm and 30 mm, a tendency of reflection to increase was observed.

In particular, when comparisons at the frequency f2 (1.65 GHz) are made among the cases when the length of the power feeding element 110 is 10 mm, 15 mm, 20 mm, 25 mm, and 30 mm, fluctuations of the S11 parameter were significant. When the length of the power feeding element 110 is 10 mm and 30 mm, the S11 parameter significantly exceeded −6 dB, and a favorable radiation characteristic was not acquired. From this, it was found that the length of the power feeding element 110 is preferably set within a range longer than 10 mm and shorter than 30 mm.

Here, since the metal plate 120 is positioned near the housing 210, a wavelength shortening effect occurs. When a wavelength shortening ratio is set at 0.7 to find a wavelength (electrical length 2) at 1.65 GHz, 2 is approximately 131 mm. A range longer than 10 mm and shorter than 30 mm may be represented as 0.07 2<the length of the power feeding element 110<0.2 2 when normalized by the wavelength at 1.65 GHz.

Figure 15:
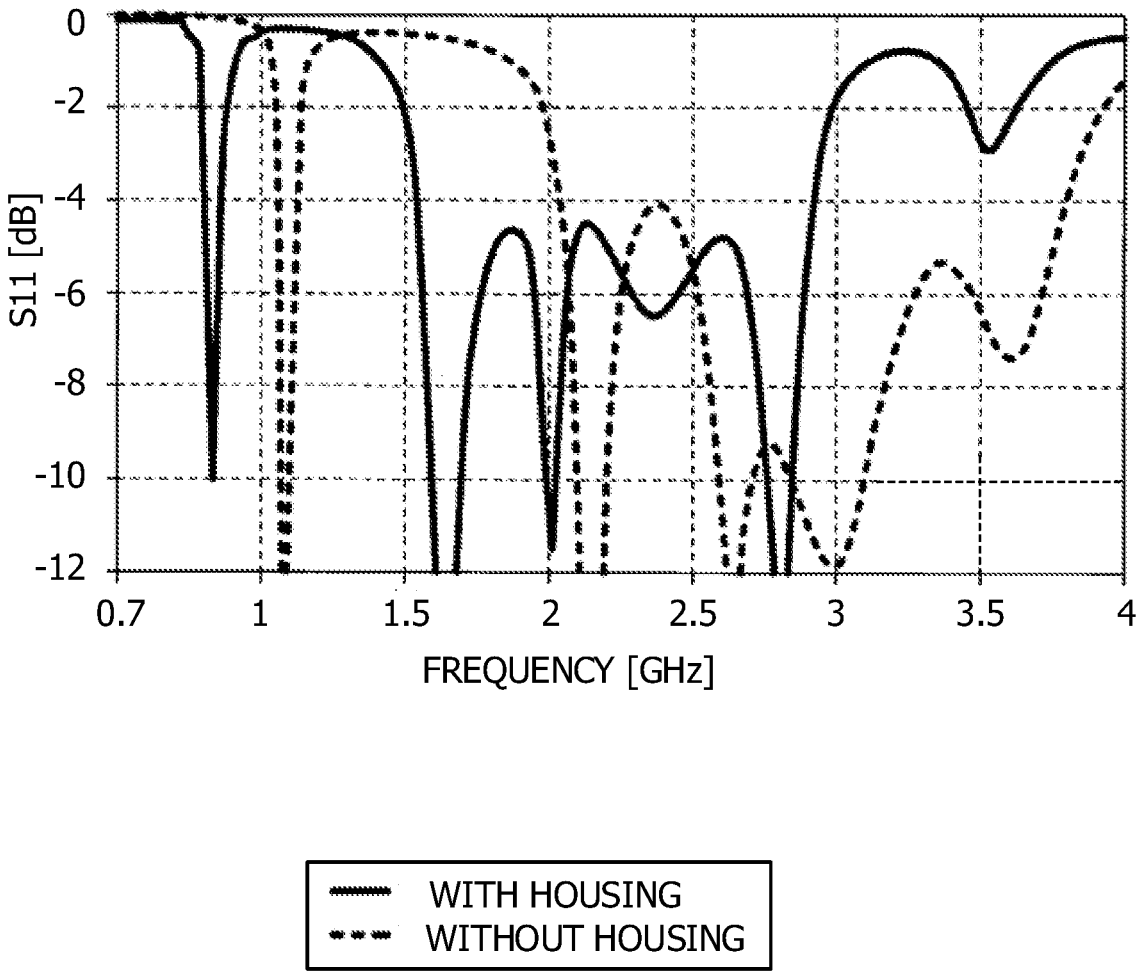
FIG. 15 is a diagram depicting differences in frequency characteristic of the S11 parameter depending on the presence or absence of a housing 210.

FIG. 15 is a diagram depicting differences in frequency characteristic of the S11 parameter depending on the presence or absence of the housing 210. A characteristic with the housing 210 is indicated by a solid line, and a characteristic without the housing 210 is indicated by a broken line. Here, as compared with the case without the housing 210, it was confirmed that the S11 parameter in the case with the housing 210 is shifted to a low frequency side as a whole. From this, it was confirmed that a wavelength shortening effect occurs in the case with the housing 210.

The frequencies f1 (0.85 GHz), f2 (1.65 GHz), f3 (2.0 GHz), and f4 (2.4 GHz) in the case with the housing 210 are lower by approximately 30%, as compared with the four frequencies (approximately 1.2 GHz, approximately 2.2 GHz, approximately 2.7 GHz, and approximately 3.0 GHz) in the case without the housing 210. This represents that the wavelength shortening effect is approximately 30%, which is the result substantially consistent with the wavelength shortening ratio (0.7) described by using FIG. 14.

Figure 16:
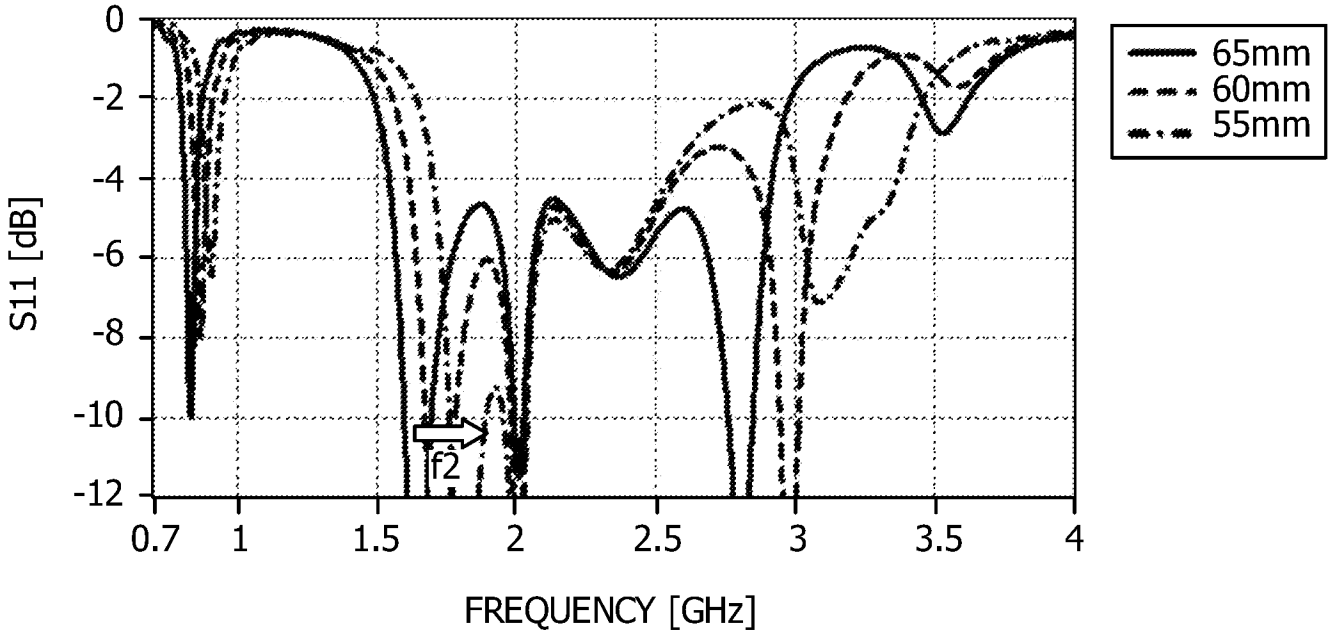
FIG. 16 is a diagram depicting frequency characteristics of the S11 parameter when the position of a connection line 132 is changed.

FIG. 16 is a diagram depicting frequency characteristics of the S11 parameter when the position of the connection line 132 is changed. Changing the position of the connection line 132 refers to changing the distance from an end of the line 122 in the Y axis positive direction (a connection part between the lines 121 and 122) to the connection line 132. While a mode of 65 mm is depicted in FIG. 7, frequency characteristics of the S11 parameter in the case of 60 mm and 55 mm in addition to 65 mm were found herein. Note that the characteristic in the case of 65 mm is indicated by a solid line, the characteristic in the case of 60 mm is indicated by a broken line, and the characteristic in the case of 55 mm is indicated by a one-dot-chain line.

Since the connection line 132 is related to the frequencies f1 (0.85 GHz) and f2 (1.65 GHz), the frequencies f1 (0.85 GHz) and f2 (1.65 GHz) fluctuated as depicted in FIG. 16. Specifically, when the position of the connection line 132 was made closer to the end of the line 122 in the Y axis positive direction as 65 mm, 60 mm, and 55 mm, the frequencies f1 (0.85 GHz) and f2 (1.65 GHz) were shifted to a high frequency side.

The reason for this occurrence is thought as follows. When the position of the connection line 132 is made closer to the end of the line 122 in the Y axis positive direction, the length of a loop constructed of the connection lines 131 and 132, the lines 121 and 122 of the metal plate 120, the edge side 50A, and the edge side 50B is shortened and the resonance frequency of the loop antenna is shifted to the high frequency side.

Figure 17:
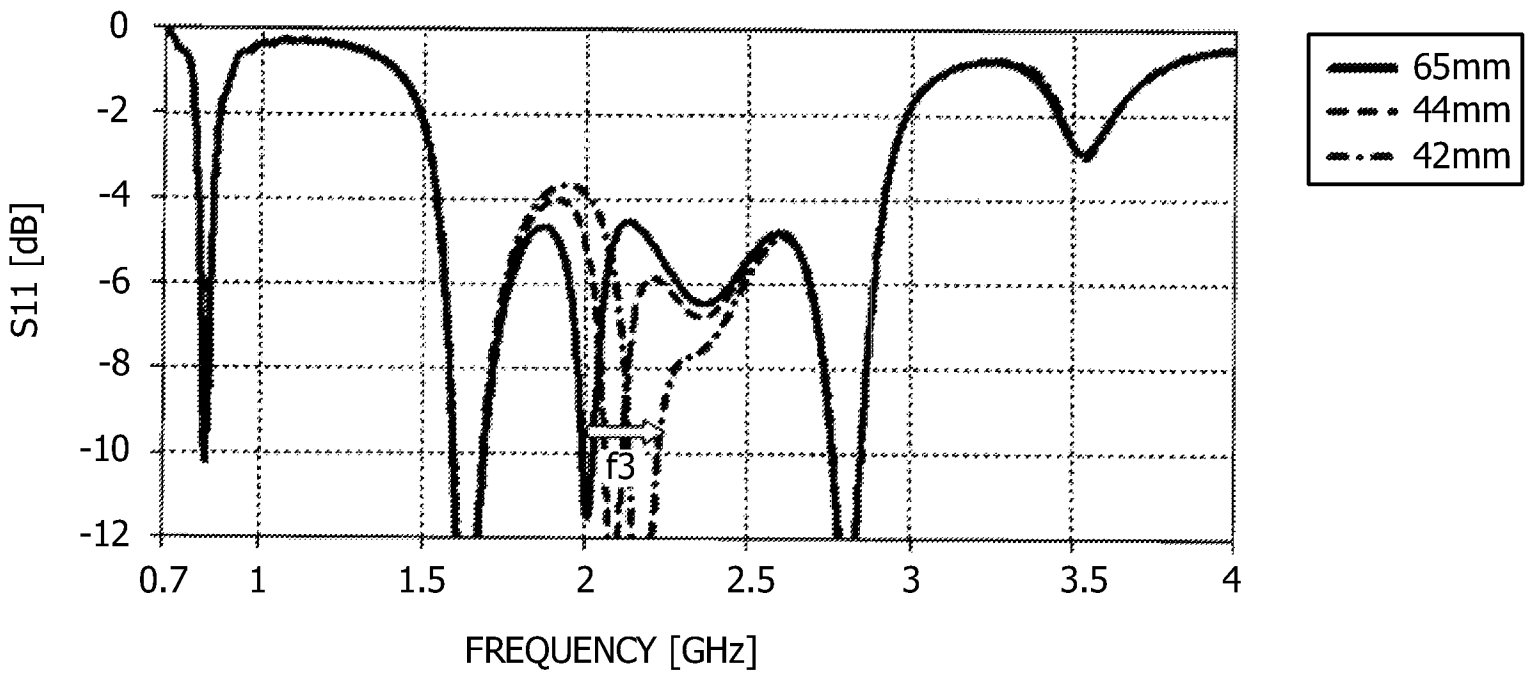
FIG. 17 is a diagram depicting frequency characteristics of the S11 parameter when the position of a connection line 133 is changed.

FIG. 17 is a diagram depicting frequency characteristics of the S11 parameter when the position of the connection line 133 is changed. Changing the position of the connection line 133 refers to changing the distance from an end of the line 123 in the Y axis positive direction (a connection part between the lines 121 and 123) to the connection line 133. While a mode of 46 mm is depicted in FIG. 7, frequency characteristics of the S11 parameter in the case of 44 mm and 42 mm in addition to 46 mm were found herein. Note that the characteristic in the case of 46 mm is indicated by a solid line, the characteristic in the case of 44 mm is indicated by a broken line, and the characteristic in the case of 42 mm is indicated by a one-dot-chain line.

Since the connection line 133 is related to the frequency f3 (2.0 GHz), the frequency f3 (2.0 GHz) fluctuated as depicted in FIG. 17. Specifically, when the position of the connection line 133 was made closer to the end of the line 123 in the Y axis positive direction as 46 mm, 44 mm, and 42 mm, the frequency f3 (2.0 GHz) was shifted to a high frequency side.

The reason for this occurrence is thought as follows. When the position of the connection line 133 is made closer to the end of the line 123 in the Y axis positive direction, the length of the loop constructed of the connection lines 131 and 133, the lines 121 and 123 of the metal plate 120, the edge side 50A, and the edge side 50C is shortened and the resonance frequency of the loop antenna is shifted to the high frequency side.

Figure 18:
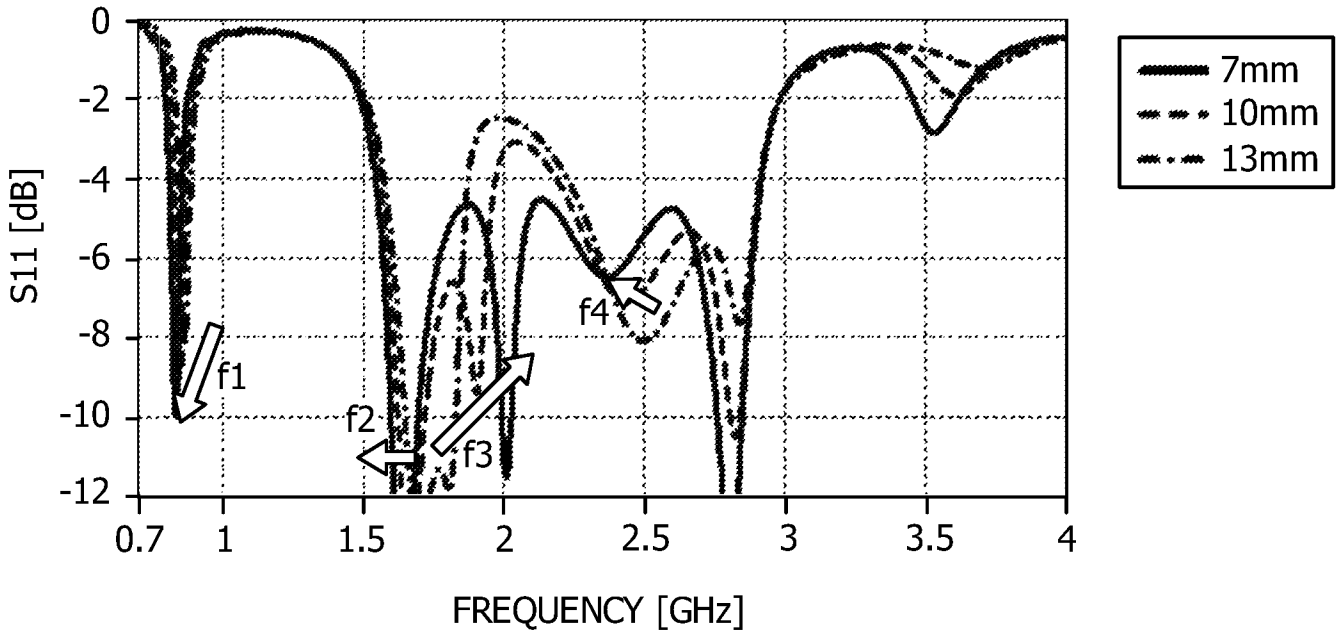
FIG. 18 is a diagram depicting frequency characteristics of the S11 parameter when the position of a connection line 131 is changed.

FIG. 18 is a diagram depicting frequency characteristics of the S11 parameter when the position of the connection line 131 is changed. Changing the position of the connection line 131 refers to changing the distance from an end of the line 121 in the X axis positive direction (a connection part between the lines 121 and 123) to the connection line 131. While a mode of 7 mm is depicted in FIG. 7, frequency characteristics of the S11 parameter in the case of 10 mm and 13 mm in addition to 7 mm are depicted herein. Note that the characteristic in the case of 7 mm is indicated by a solid line, the characteristic in the case of 10 mm is indicated by a broken line, and the characteristic in the case of 13 mm is indicated by a one-dot-chain line.

Since the connection line 131 is related to all of the frequencies f1 (0.85 GHz), f2 (1.65 GHz), f3 (2.0 GHz), and f4 (2.4 GHz), the frequencies f1 (0.85 GHz), f2 (1.65 GHz), f3 (2.0 GHz), and f4 (2.4 GHz) fluctuated as depicted in FIG. 18. Specifically, when the position of the connection line 131 was made closer to the end of the line 121 in the X axis positive direction as 13 mm, 10 mm, and 7 mm, the frequencies f1 (0.85 GHz), f2 (1.65 GHz), and f4 (2.4 GHz) were shifted to a low frequency side, and the frequency f3 (2.0 GHz) was shifted to a high frequency side.

The reason for this is thought as follows. When the position of the connection line 131 is made closer to the end of the line 121 in the X axis positive direction, the loop resonating at the frequencies f1 (0.85 GHz), f2 (1.65 GHz), and f4 (2.4 GHz) becomes long and the resonance frequency is thus shifted to the low frequency side and the loop resonating at the frequency f3 (2.0 GHz) becomes short and the resonance frequency is thus shifted to the high frequency side.

These results are consistent with the fact that a loop current is acquired at the above-described four frequencies f1 (0.85 GHz), f2 (1.65 GHz), f3 (2.0 GHz), and f4 (2.4 GHz).

As described above, according to the embodiment, the antenna device 100 is acquired, the antenna device 100 being capable of communication at the four frequencies f1 (0.85 GHz), f2 (1.65 GHz), f3 (2.0 GHz), and f4 (2.4 GHz) with a simple structure using the ground plane 50, the power feeding element 110, the metal plate 120, and the connection lines 131, 132, and 133.

The antenna device 100 is capable of communication at the four bands with a fixed, simple structure including the power feeding element 110, the metal plate 120, and the connection lines 131, 132, and 133, without switching connection by a switch or the like. That is, the antenna device 100 rendered multiband with a simple structure may be provided.

Also, since communication at the four bands is not achieved by switching by a switch or the like but is available at any time, it is possible to easily support carrier aggregation.

Also, the metal plate 120 is present on an exterior surface of the wireless communication device 200 including the antenna device 100 and the electronic device, and has a role in reinforcing the housing 210. This means that the reinforcing member (metal plate 120) is used as an antenna element. That is, with a simple structure using the reinforcing member as an antenna element, the multiband antenna device 100 capable of supporting carrier aggregation may be provided.

Also, the length of the metal plate 120 between the connection line 134A and the connection line 133 is set to be shorter than the length (4/2), which is ½ of the electrical length of the wavelength 4 at the frequency f4, thereby keeping communication characteristics at the frequencies f1, f2, f3, and f4 from degradation. The same goes for the position of the connection line 135A. Since the connection lines 134A and 135A are metal members supporting the metal plate 120, the antenna device 100 rendered multiband with a simple structure is achieved by optimizing the position of the metal members supporting the metal plate 120.

Note that the mode has been described above in which the four corners (joint parts of the lines 121 to 124) of the metal plate 120 are each bent at the right angle, but a shape with rounded four corners may be adopted.

Figure 19:
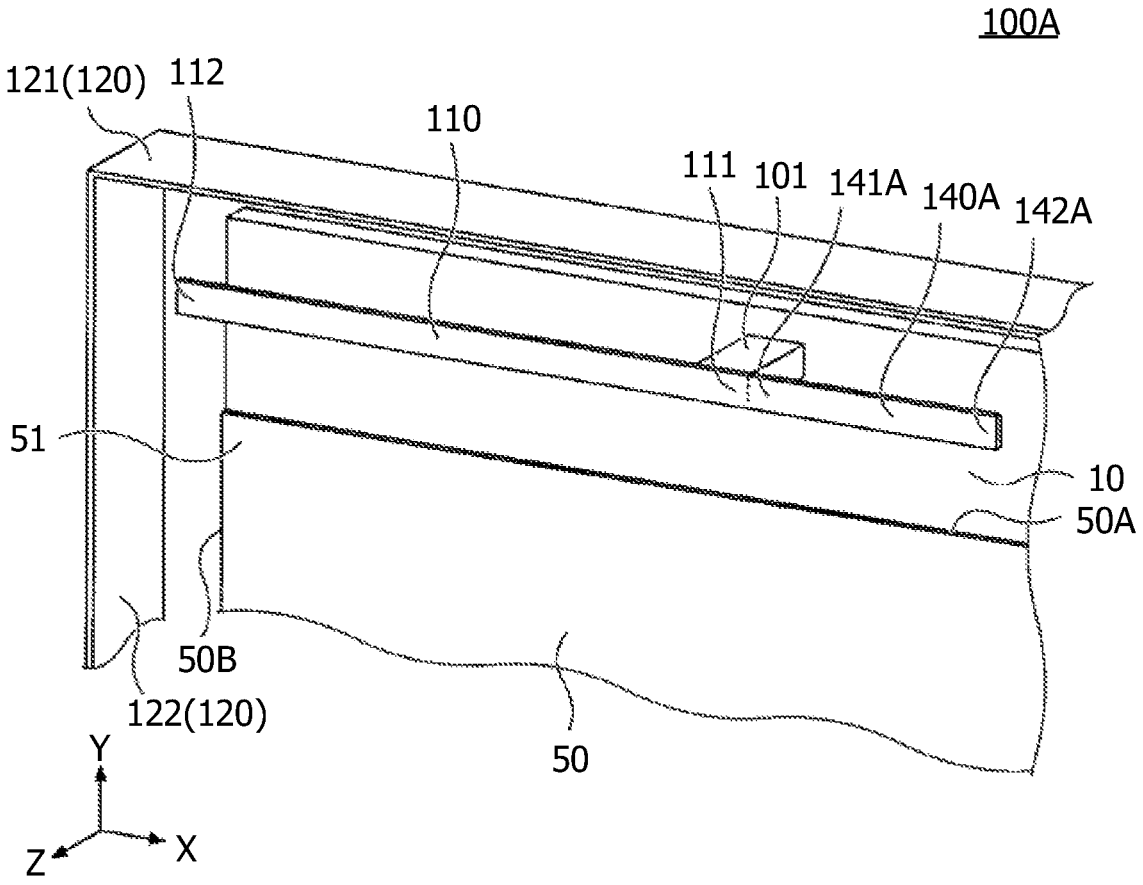
FIG. 19 is a diagram depicting an antenna device 100A of a modification example of the embodiment.
Figure 20:
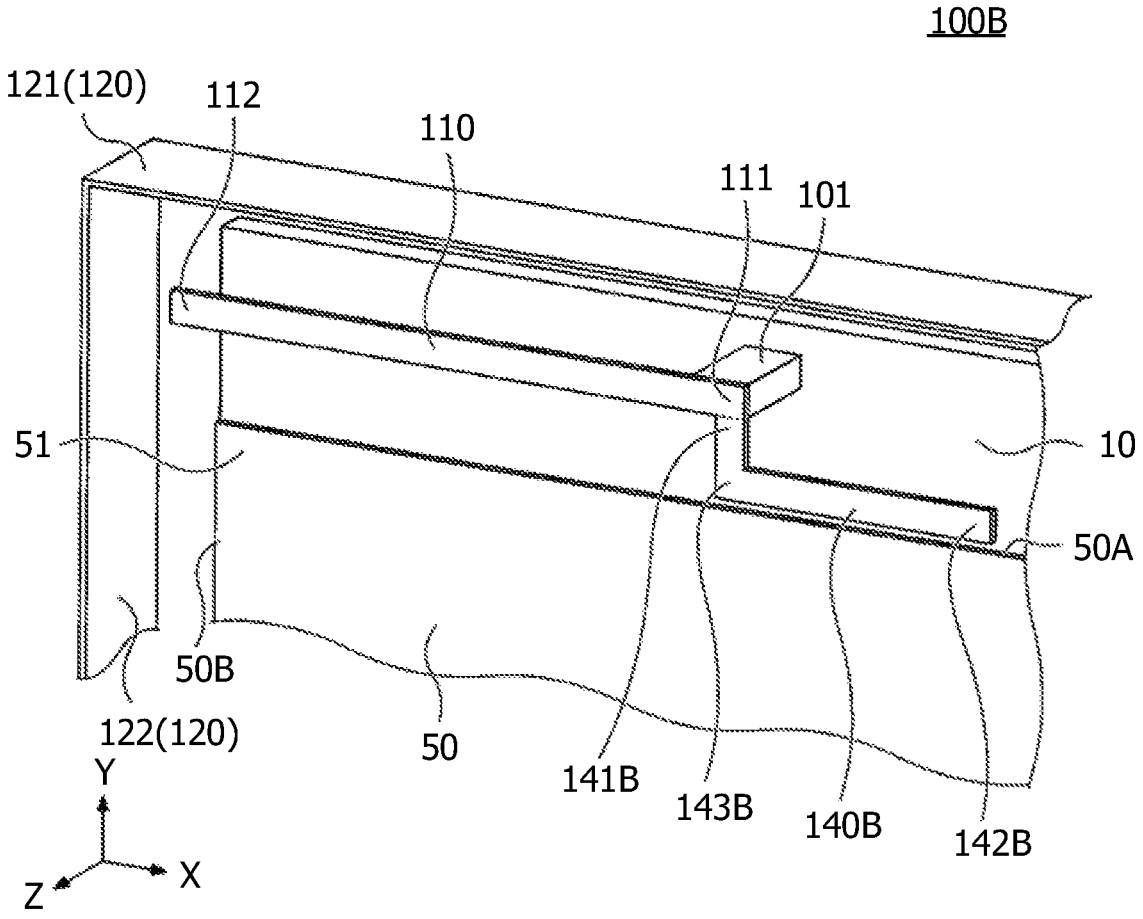
FIG. 20 is a diagram depicting an antenna device 100B of a modification example of the embodiment.

Also, a structure may be adopted in which a fifth communication band may be provided by loading a branch element to the power feeding element 110. FIG. 19 is a diagram depicting an antenna device 100A of a modification example of the embodiment. FIG. 20 is a diagram depicting an antenna device 100B of a modification example of the embodiment.

The antenna device 100A depicted in FIG. 19 has a structure with the power feeding element 110 of the antenna device 100 depicted in FIG. 1 to FIG. 5 additionally provided with a branch element 140A. The branch element 140A is a linear antenna element having a connection end 141A and an open end 142A.

The branch element 140A has the connection end 141A connected to the power feeding point 111, and extends to the open end 142A to the X axis direction. The length of the branch element 140A from the connection end 141A to the open end 142A is set at a length (5/4), which is ¼ of the electrical length of a wavelength 5 at a frequency f5.

The frequency f5 is, by way of example, 3.5 GHz, which is a frequency higher than the frequencies f1, f2, f3, and f4. The branch element 140A functions as a monopole antenna in cooperation with the ground plane 50, allowing communication at the frequency f5. Note that the length of the branch element 140A is, by way of example, 8.5 mm.

Also, the antenna device 100B depicted in FIG. 20 has a structure in which a branch element 140B is added to the power feeding element 110 of the antenna device 100 depicted in FIG. 1 to FIG. 5. The branch element 140B is an L-shaped antenna element having a connection end 141B, an open end 142B, and a bent part 143B.

The branch element 140B has the connection end 141B connected to the power feeding point 111, extends from the connection end 141B to the bent part 143B to a Y axis negative direction side, is bent at the bent part 143B at the right angle to the X axis positive direction, and extends to the open end 142B to the X axis direction.

The length of the branch element 140B from the connection end 141B via the bent part 143B to the open end 142B is set at a length (5/4), which is ¼ of the electrical length of the wavelength 5 at the frequency f5. The frequency f5 is, by way of example, 3.5 GHz. The branch element 140B functions as a monopole antenna in cooperation with the ground plane 50, allowing communication at the frequency f5. Note that the length of the branch element 140B is, by way of example, 4 mm between the connection end 141B and the bent part 143B and 10 mm between the bent part 143B and the open end 142B.

Figure 21:
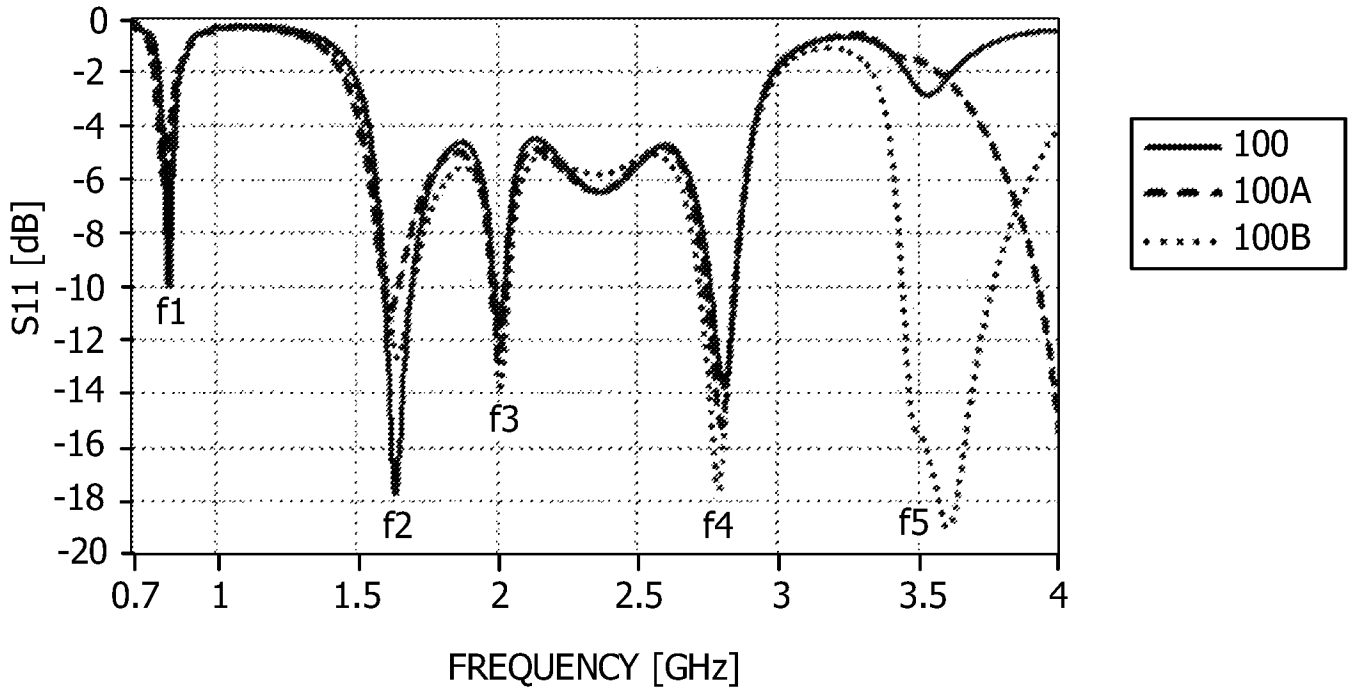
FIG. 21 is a diagram depicting frequency characteristics of the S11 parameter of the antenna devices 100, 100A, and 100B.

FIG. 21 is a diagram depicting frequency characteristics of the S11 parameter of the antenna devices 100, 100A, and 100B. The characteristic of the antenna device 100 is indicated by a solid line, the characteristic of the antenna device 100A is indicated by a broken line, and the characteristic of the antenna device 100B is indicated by a one-dot-chain line. The characteristic of the antenna device 100 is identical to the characteristic depicted in FIG. 8.

As compared with the antenna device 100, in the antenna devices 100A and 1006, resonance at frequencies higher than the frequency f4 was acquired. Resonance occurred at approximately 4 GHz in the antenna device 100A, and resonance occurred at 3.5 GHz (f5) in the antenna device 1006. While the resonance frequency of the antenna device 100A is higher than f5, it is thought that this is adjustable to 3.5 GHz (f5) by using a matching circuit.

As depicted in FIG. 19 to FIG. 21, the antenna device 100A including the branch element 140A and the antenna device 100B including the branch element 140B are capable of communication at the five bands with a fixed, simple structure. That is, the antenna devices 100A and 100B each rendered multiband with a simple structure may be provided.

Figure 22:
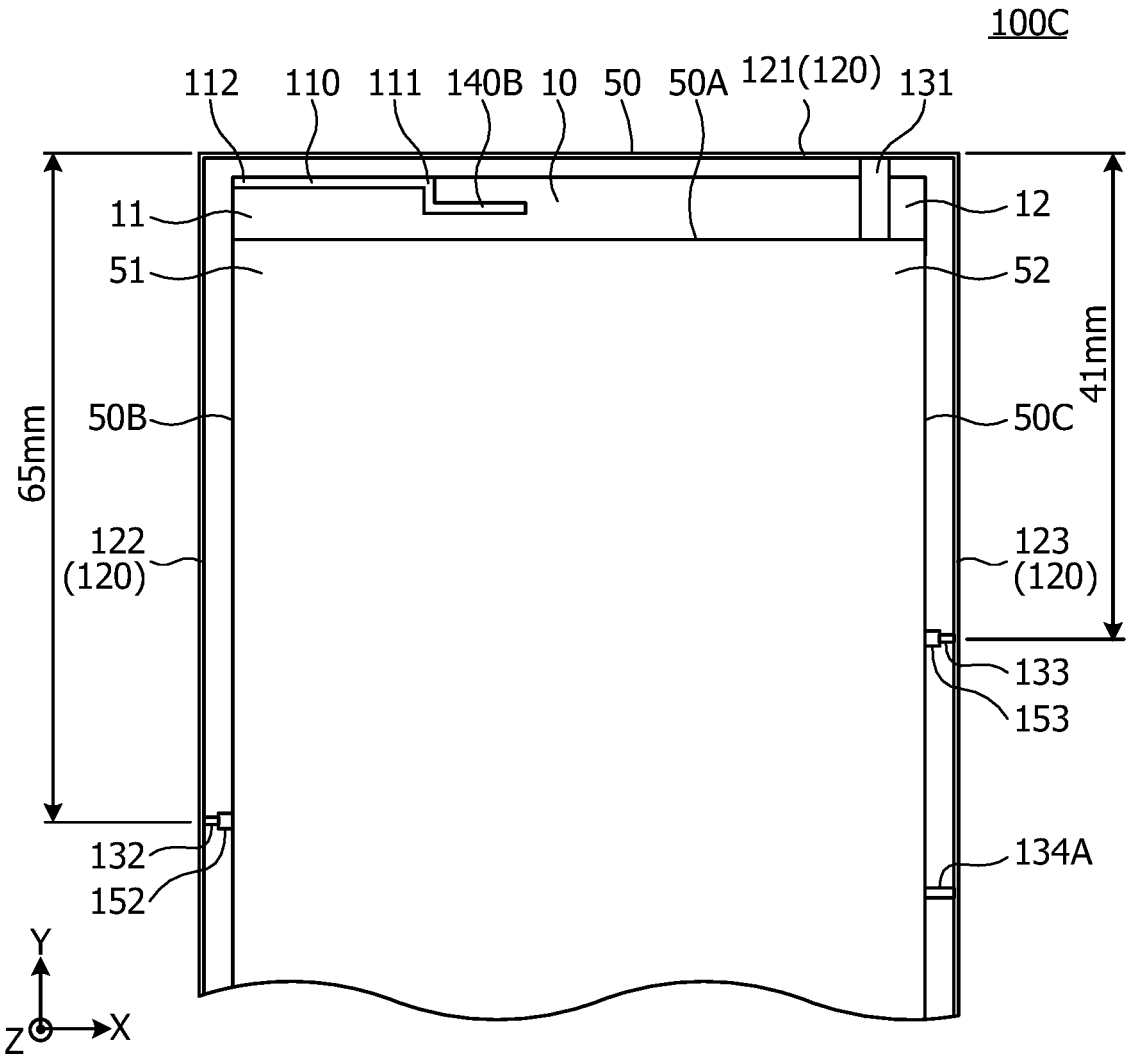
FIG. 22 is a diagram depicting an antenna device 100C of a modification example of the embodiment.

FIG. 22 is a diagram depicting an antenna device 100C of a modification example of the embodiment. The antenna device 100C has a structure in which the branch element 140B (refer to FIG. 20) is added to the antenna device 100 depicted in FIG. 4 and adjustment circuits 152 and 153 are inserted between the connection lines 132 and 133 and the ground plane 50. Note that the length between the connection line 132 and an end of the line 122 on the Y axis positive direction side is 65 mm, and the length between the connection line 133 and an end of the line 123 on the Y axis positive direction side is 41 mm.

Figure 23:
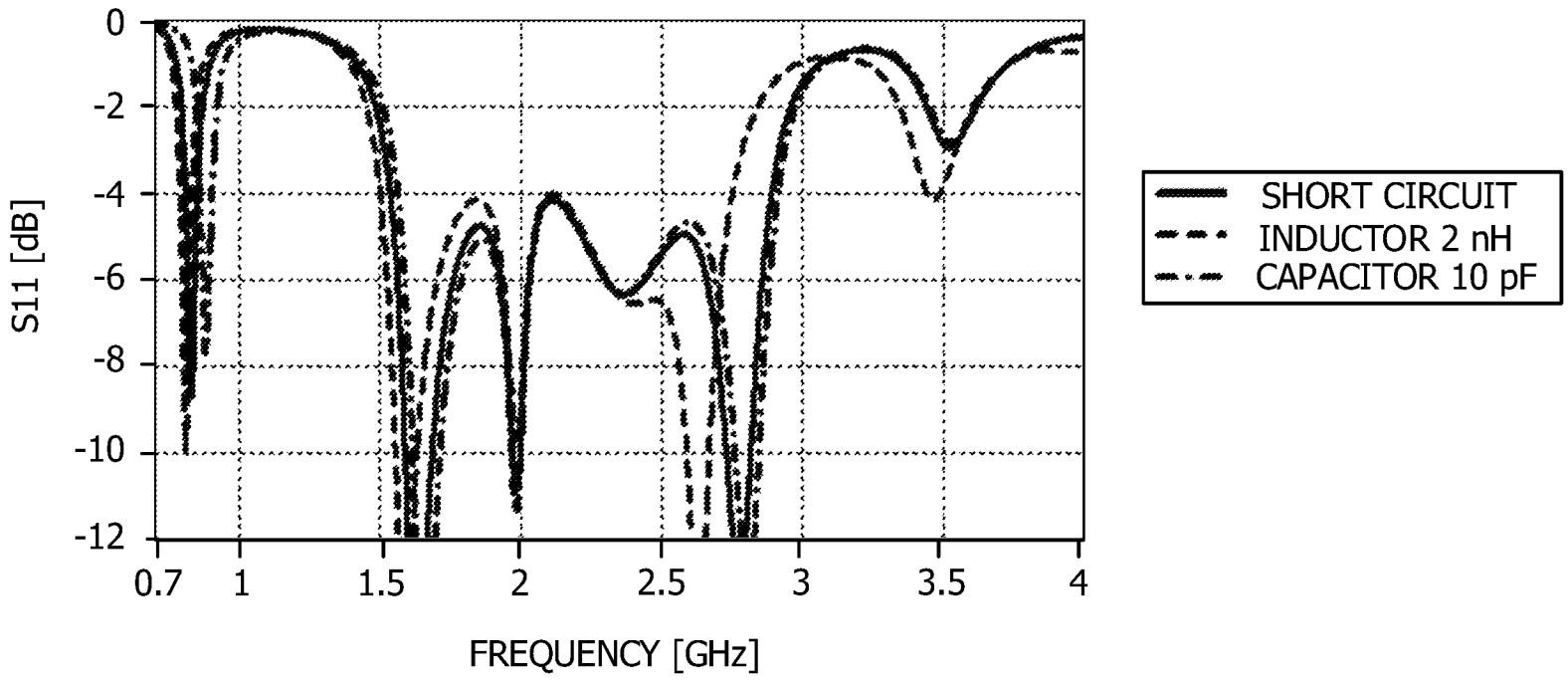
FIG. 23 is a diagram depicting frequency characteristics of the S11 parameter of the antenna device 100C when the impedance of an adjustment circuit 152 is changed.

FIG. 23 is a diagram depicting frequency characteristics of the S11 parameter of the antenna device 100C when the impedance of the adjustment circuit 152 is changed. S11 parameters were found in the cases in which the adjustment circuit 152 was short-circuited (solid line), an inductor of 2 nH was inserted in series to the connection line 132 (broken line), and a capacitor of 10 pF was inserted in series to the connection line 132 (one-dot-chain line). Note that the case in which the adjustment circuit 152 was short-circuited is the case in which the ground plane 50 and the metal plate 120 were connected by the connection line 132 as depicted in FIG. 4 without insertion of the adjustment circuit 152.

As compared with the case in which the adjustment circuit 152 was short-circuited, the 800 MHz band and the 1.5 GHz band were shifted to a low frequency side when the inductor was inserted, and the 800 MHz band and the 1.5 GHz band were shifted to a high frequency side when the capacitor was inserted. From this, it was confirmed that the resonance frequency is adjustable by inserting the adjustment circuit 152 as an inductor or capacitor into the connection line 132.

Figure 24:
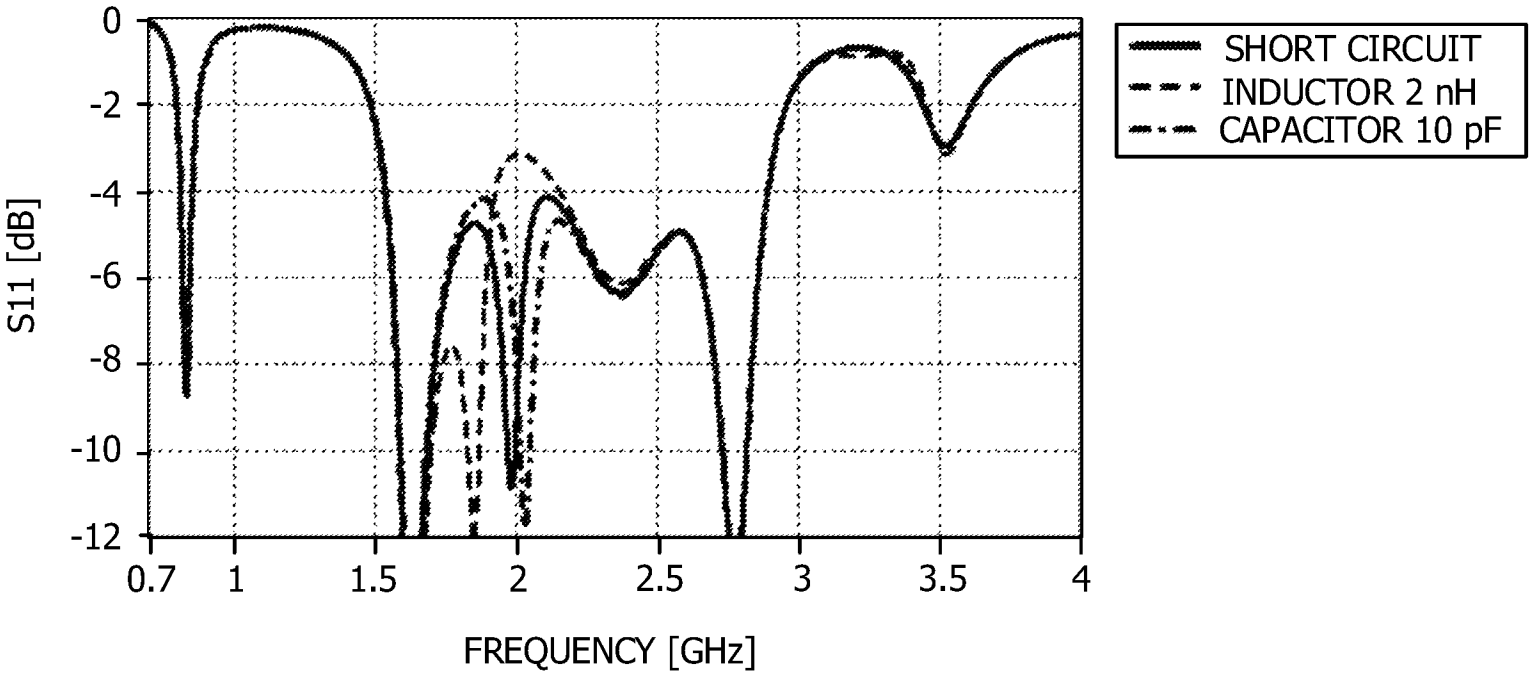
FIG. 24 is a diagram depicting frequency characteristics of the S11 parameter of the antenna device 100C when the impedance of an adjustment circuit 153 is changed.

FIG. 24 is a diagram depicting frequency characteristics of the S11 parameter of the antenna device 100C when the impedance of the adjustment circuit 153 is changed. S11 parameters were found in the cases in which the adjustment circuit 153 was short-circuited (solid line), an inductor of 2 nH was inserted in series to the connection line 133 (broken line), and a capacitor of 10 pF was inserted in series to the connection line 133 (one-dot-chain line). Note that the case in which the adjustment circuit 153 was short-circuited is the case in which the ground plane 50 and the metal plate 120 were connected by the connection line 133 as depicted in FIG. 4 without insertion of the adjustment circuit 153.

As compared with the case in which the adjustment circuit 153 was short-circuited, the 1.9 GHz band was shifted to a low frequency side when the inductor was inserted, and the 1.9 GHz band was shifted to a high frequency side when the capacitor was inserted. From this, it was confirmed that the resonance frequency is adjustable by inserting the adjustment circuit 153 as an inductor or capacitor into the connection line 133.

Also, it was confirmed from this that the resonance frequency is adjustable by inserting the adjustment circuit 153 without changing the position of the connection line 133 to the Y axis direction. For example, when the position of the connection line 133 is limited due to the positional relation with a circuit component included in the electronic device or the like, the use of the adjustment circuit 153 allows impedance matching at a desired resonance frequency.

Also, while the above description has been made by using the wavelengths 1, 2, 3, 4, and 5 of basic waves of the frequencies f1, f2, f3, f4, and f5, communications at the frequencies f1, f2, f3, f4, and f5 may be made possible by setting so that the wavelengths of harmonics of orders equal to or higher than the second order at the frequencies f1, f2, f3, f4, and f5 satisfy the above-described conditions.

While the antenna device and the wireless communication device of the exemplary embodiment of the present invention has been described above, the present invention is not limited to the specifically disclosed embodiment and may be variously modified or changed without deviating from the scope of the claims.

The following appendices are further disclosed regarding the above-described embodiment.

(Appendix 1)

An antenna device including:

a ground plane which has an edge side;

a metal member arranged along the edge side of the ground plane;

a first connection line which connects the metal member and the ground plane;

a second connection line which connects the metal member and the ground plane; and a power feeding element which has a power feeding point, extends along the metal member from the power feeding point between the first connection line and the second connection line, and is electromagnetic-field-coupled to the metal member.

(Appendix 2)

The antenna device according to appendix 1, in which a length of the metal member between the first connection line and the second connection line is a length corresponding to ½ of a first wavelength at a first frequency and is a length corresponding to a second wavelength at a second frequency which is a double of the first frequency.

(Appendix 3)

The antenna device according to appendix 2, in which a first loop constructed of the metal member, the first connection line, the second connection line, and the ground plane constructs a loop antenna which resonates at the first frequency and the second frequency.

(Appendix 4)

The antenna device according to appendix 2 or 3, in which a length of the power feeding element is longer than 0.07 times of a length of a wavelength at the second frequency and shorter than 0.2 times of the length of the wavelength at the second frequency.

(Appendix 5)

The antenna device according to any one of appendices 1 to 4, further including:

an inductor or capacitor loaded on the second connection line.

(Appendix 6)

The antenna device according to any one of appendices 1 to 5, further including:

a third connection line which connects the metal member and the ground plane oppositely to the second connection line with respect to the first connection line.

(Appendix 7)

The antenna device according to appendix 6, further including:

an inductor or capacitor loaded on the third connection line.

(Appendix 8)

The antenna device according to appendix 6 or 7, in which a length of the metal member between the first connection line and the third connection line is a length corresponding to ½ of a third wavelength at a third frequency.

(Appendix 9)

The antenna device according to appendix 8, in which a second loop constructed of the metal member, the first connection line, the third connection line, and the ground plane constructs a loop antenna which resonates at the third frequency.

(Appendix 10)

The antenna device according to any one of appendices 1 to 9, in which a distance between a position corresponding to the power feeding point on the edge side of the ground plane and a position where the first connection line is connected to the ground plane is set at a distance represented by a length corresponding to ½ of a fourth wavelength in a fourth frequency.

(Appendix 11)

The antenna device according to any one of appendices 1 to 10, further including:

a branch element which is connected to the power feeding element at the power feeding point, extends from the power feeding point to a direction opposite to the power feeding element along the metal member, and has a length corresponding to ¼ of a wavelength at a fifth frequency.

(Appendix 12)

A wireless communication device including:

a substrate; and an antenna device disposed on the substrate, in which the antenna device includes a ground plane which has an edge side, a metal member arranged along the edge side of the ground plane, a first connection line which connects the metal member and the ground plane, a second connection line which connects the metal member and the ground plane, and a power feeding element which has a power feeding point, extends along the metal member from the power feeding point between the first connection line and the second connection line, and is electromagnetic-field-coupled to the metal member.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. An antenna device comprising:

a ground plane which has an edge side;

a metal member arranged along the edge side of the ground plane;

a first connection line which couples the metal member and the ground plane;

a second connection line which couples the metal member and the ground plane; and a power feeding element which has a power feeding point which is not physically in contact with the metal member, extends in parallel with the metal member from the power feeding point between the first connection line and the second connection line, keeps a specific distance from the metal member, includes the power feeding point and an open end at respective ends of the power feeding element and is electromagnetic-field-coupled to the metal member, wherein the power feeding point is coupled to a substrate including the ground plane via an elastic member which extends in a vertical direction of a surface of the substrate, and the antenna device performs communication in four or more frequency bands which are different from each other.

2. The antenna device according to claim 1, further comprising:

an inductor or capacitor loaded on the second connection line.

3. The antenna device according to claim 1, further comprising:

a third connection line which couples the metal member and the ground plane oppositely to the second connection line with respect to the first connection line.

4. The antenna device according to claim 3, further comprising:

an inductor or capacitor loaded on the third connection line.

5. The antenna device according to claim 3, wherein a length of the metal member between the first connection line and the third connection line is a length corresponding to ½ of an electrical length of a third wavelength at a third frequency which is one frequency having radiation characteristic with less reflection than other frequencies in frequency characteristic of the antenna device.

6. The antenna device according to claim 5, wherein a second loop constructed of the metal member, the first connection line, the third connection line, and the ground plane constructs a loop antenna which resonates at the third frequency.

7. The antenna device according to claim 1, wherein a distance between a position corresponding to the power feeding point on the edge side of the ground plane and a position where the first connection line is connected to the ground plane is set at a distance represented by a length corresponding to ½ of an electrical length of a fourth wavelength in a fourth frequency which is one frequency having radiation characteristic with less reflection than other frequencies in frequency characteristic of the antenna device.

8. The antenna device according to claim 1, further comprising:

a branch element which is coupled to the power feeding element at the power feeding point, extends from the power feeding point to a direction opposite to the power feeding element along the metal member, and has a length corresponding to ¼ of an electrical length of a wavelength at a fifth frequency which is one frequency having radiation characteristic with less reflection than other frequencies in frequency characteristic of the antenna device.

9. A wireless communication device comprising:

a substrate; and an antenna device disposed on the substrate, wherein the antenna device includes:

a ground plane which has an edge side;

a metal member arranged along the edge side of the ground plane;

a first connection line which couples the metal member and the ground plane;

a second connection line which couples the metal member and the ground plane; and a power feeding element which has a power feeding point which is not physically in contact with the metal member, extends in parallel with the metal member from the power feeding point between the first connection line and the second connection line, keeps a specific distance from the metal member, includes the power feeding point and an open end at respective ends of the power feeding element and is electromagnetic-field-coupled to the metal member, wherein the power feeding point is coupled to the substrate via an elastic member which extends in a vertical direction of a surface of the substrate, and the antenna device performs communication in four or more frequency bands which are different from each other.

10. The wireless communication device according to claim 9, wherein the antenna device further includes an inductor or capacitor loaded on the second connection line.

11. The wireless communication device according to claim 9, wherein the antenna device further includes a third connection line which couples the metal member and the ground plane oppositely to the second connection line with respect to the first connection line.

12. The wireless communication device according to claim 11, wherein the antenna device further includes an inductor or capacitor loaded on the third connection line.

13. The wireless communication device according to claim 9, wherein a distance between a position corresponding to the power feeding point on the edge side of the ground plane and a position where the first connection line is connected to the ground plane is set at a distance represented by a length corresponding to ½ of an electrical length of a fourth wavelength in a fourth frequency.

14. The wireless communication device according to claim 9, further comprising:

a branch element which is coupled to the power feeding element at the power feeding point, extends from the power feeding point to a direction opposite to the power feeding element along the metal member, and has a length corresponding to ¼ of an electrical length of a wavelength at a fifth frequency which is one frequency having radiation characteristic with less reflection than other frequencies in frequency characteristic of the antenna device.

* * * * *